US007093717B2

(12) United States Patent
Sakai et al.

(10) Patent No.: US 7,093,717 B2
(45) Date of Patent: Aug. 22, 2006

(54) TRAY PACK AND PACKAGING STRUCTURE

(75) Inventors: Shuhei Sakai, Kawasaki (JP); Miyuki Akimoto, Kawasaki (JP); Katsuya Fujii, Kawasaki (JP); Hiroshi Katagiri, Kawasaki (JP); Kiyonori Kusuda, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 136 days.

(21) Appl. No.: 10/268,158

(22) Filed: Oct. 10, 2002

(65) Prior Publication Data

US 2003/0146128 A1 Aug. 7, 2003

(30) Foreign Application Priority Data

Feb. 6, 2002 (JP) ..... 2002-029857

(51) Int. Cl.
*B65D 81/02* (2006.01)
*B65D 85/30* (2006.01)
*B65D 1/34* (2006.01)

(52) U.S. Cl. ..... 206/591; 206/564; 206/583

(58) Field of Classification Search ..... 206/583, 206/588, 591, 592, 594, 706, 722–724, 564, 206/521; 220/780
See application file for complete search history.

(56) References Cited

U.S. PATENT DOCUMENTS 3,256,975 A * 6/1966 Puente ..... 206/706
4,673,605 A * 6/1987 Sias et al. ..... 428/120
5,226,372 A * 7/1993 Frenkel et al. ..... 108/57.12
5,320,226 A * 6/1994 Merrill ..... 206/521
5,643,656 A * 7/1997 Lin ..... 206/521.1
5,685,429 A * 11/1997 Myers ..... 206/455
5,738,219 A * 4/1998 Arsena et al. ..... 206/706
6,105,765 A * 8/2000 Chu ..... 206/320
6,298,989 B1 * 10/2001 Chu ..... 206/320
2001/0020595 A1 * 9/2001 Koike ..... 206/521

FOREIGN PATENT DOCUMENTS

JP 7-19169 4/1995
JP 2000-128246 5/2000
JP 2002-037349 2/2002

* cited by examiner

*Primary Examiner*—Mickey Yu
*Assistant Examiner*—J. Gregory Pickett
(74) *Attorney, Agent, or Firm*—Katten Muchin Rosenman LLP

(57) ABSTRACT

The object of the invention is to construct a simple packaging structure having few components and capable of protecting a contained product against shock impacts coming from all directions. To this end, the packaging structure according to the present invention is made of synthetic resin with an elastic quality molded into a sheet form, and includes a first tray pack and a second tray pack which face each other and are adjoined to hold the contained product securely in place; wherein the first and second tray packs are provided with sustaining portions sustaining the periphery of the contained product.

4 Claims, 27 Drawing Sheets

UNIT: 1.2kg
HEIGHT OF FALL: 75cm

FALLING DIRECTION

COMPARISON OF PERFORMANCES (SHOCK IMPACT VALUES)
BETWEEN THE CONVENTIONAL PACKAGE AND THE TRAY PACK PACKAGE

UNIT: G

| FALLING DIRECTION | S1 | S2 | S3 | S4 | S5 | S6 | E1 | E2 | E3 | E4 | E5 | E6 | E7 | E8 | E9 | C1 | C2 | C3 | C4 |
|---|---|---|---|---|---|---|---|---|---|---|---|---|---|---|---|---|---|---|---|
| CONVENTIONAL | 45 | 25 | 29 | 48 | 35 | 50 | 25 | 33 | 35 | 20 | 29 | 39 | 26 | 32 | 20 | 11 | 6 | 11 | 20 |
| TRAY PACK | 50 | 30 | 35 | 48 | 41 | 54 | 25 | 35 | 40 | 22 | 30 | 42 | 34 | 36 | 23 | 16 | 18 | 16 | 24 |

※IT CAN BE VERIFIED THAT THE PERFORMANCE OF THE TRAY PACK PACKAGE EQUALS THAT OF THE CONVENTIONAL PACKAGE.

TRAY PACK AND PACKAGING STRUCTURE

BACKGROUND OF THE INVENTION

1. Field of the Invention

The present invention relates to a new packaging structure, with shock diffusion functions, convenient for transporting or storing a packaged product such as a circuit unit having a printed wiring board.

Various types of communication apparatuses, information processing apparatuses, and measuring apparatuses, use circuit units having printed wiring boards, for instance, which are equipped with signal processing power having a very large capacity and great accuracy, and composed of a high density of electronic components.

Such circuit units are typically transported to a site where the apparatus is to be set up in individual packages separate from each other and the rest of the apparatus. Thus, great care needs to be taken in packaging the units so as to protect them from various vibration and shock impacts during transportation of the units, and during storage in a warehouse. Particularly, the packaged units will need to be protected from unpredictably high shock impacts from dropping due to carelessness during human handling or collapsing of stored piles.

FIG. 26 is a diagrammatic representation of a circuit unit as an example of a product contained within the present invention, wherein FIG. A shows a top view, FIG. B a side view, and FIG. C a front view. In the circuit unit 1 of this figure, electrical components are connected to a circuit pattern, comprising the circuit functions, on the surface of a printed wiring board 2, and a metallic shield cover 3 is mounted over the entire surface of the board 2 so as to protect the circuit unit 1 electromagnetically.

On the front side, a metallic front panel 4 is placed in order to arrange operation components and various indications, and at its ends, rotational lever plug fitting 5 are placed on the printed wiring board 2 so that the panel 4 can be easily put on and taken off from a shelf of the apparatus.

Also, on the back side, multipolar connectors 6, which are plugged into and thus electrically connected to the connector of the backboard of the apparatus shelf, are vertically aligned and connected to the printed wiring board 2.

2. Related Art

The conventional way of packaging a product such as the circuit unit 1 for its transportation, etc. is (see FIG. 27): to cover the circuit unit 1 with a transparent film 11 made of conductive synthetic resin in order to protect the unit from electrostatics, to insert it into a frame 12 made of expanded polystyrene resin or expanded urethane resin; to place sheets 13 of the same material on the top and bottom of the unit within the frame 12 in order hold it in place; to place boards 14 also of the same material on the top and bottom surface of the frame 12; to place cardboards 16 provided with cushion sheets 15 on the top and bottom; and then to put the unit packaged in this order into a cardboard box 17 as shown in FIG. 27A. An illustration of the completed box package is shown in FIG. 27B.

SUMMARY OF THE INVENTION

Performing the packaging in accordance with the method shown in FIG. 27 requires not only a large number of components including frame 12, sheet 13, board 14, and cardboard 16, but also a significant amount of time for inserting the components into place. The external package will inevitably be rather large since protection against vibration and shock is dependent upon the elasticity of the materials, with the only function of the cardboard box being to contain all these pieces together.

Recently, for the purpose of reducing its size, packaging structures using, as its packaging material, a sheet made of relatively thin synthetic resin having both rigidity and elasticity and capable of elastically changing shape is being developed. However, some of the above packaging structures are not fit for packaging circuit units, since they do not have the shock diffusing functions that can ensure shock absorption and control from every possible direction, which is a requirement for the packaging of a circuit unit.

Most of the above packaging structures have functions for diminishing shock directed onto its surfaces; however, they are not equipped with protective functions against shock directed at the edges or corners of the packaging structure. Thus these packaging structures are not suitable for packaging circuit units and the like.

Thus, the object of the present invention is to solve the above-mentioned problems by providing a simple packaging structure, having few components, that is capable of protecting the packaged product against shocks coming from all directions.

To this end, the packaging structure according to the present invention includes: a tray pack made of elastic material having a first tray pack and a second tray pack provided with sustaining portions sustaining the periphery of a contained product; a plate portion composed of protrusions/indentations/indentations of different sizes and heights, said plate being spaced apart from the above contained product; and a curved surface, formed on the outer sides of the tray pack, enabling elastic deformation around the above sustaining portions, and composed of at least a first curved surface and a second curved surface that extends from the first curved surface. In this packaging structure the first tray pack and the second tray pack are faced opposite each other and are adjoined together so as to suspend the contained product securely in place by fitting together concave and convex engaging portions formed at the perimeters of said first and second tray packs.

According to the above first means for solving the problems of the conventional art, the contained product is suspended inside the tray pack by partially touching the members of the tray pack. In order to cope with shock impacts from unpredictable incidences such as falling, tip portions of the largest and tallest protrusions/indentations/indentations on the plate are formed so as to absorb the shock impacts on the plate by means of compression deformation due to their elasticity. For shock impacts that are greater, the extent of compression deformation will also be greater, and the tip portions of the smaller and shorter protrusions/indentations/indentations will similarly experience compression deformation from their elasticity in due order. Thus the shock impact is absorbed and the contained product is protected from harm. These protrusions/indentations/indentations recover their shapes due to their elasticity after the shock impact is absorbed.

Along with the deformation of the protrusions/indentations of the plate as described above, each of the individual curved surfaces of the outer perimeter of the tray pack can also perform elastic deformation with their two ends as the fulcrum. Thus, a synergistic effect of effectively absorbing and diffusing shock impacts can be achieved.

As for shock impacts in the direction perpendicular to the plate, the outer perimeter of the curved surface will receive the shock and thus the individual curved surfaces will similarly experience elastic deformation with their two ends as the fulcrum, so as to absorb and diffuse the shock impacts.

As for shock impacts in a direction diagonal to the plate, elastic deformation occurs in accordance with a combination of the above-described shock absorption effects, and thus protection of the contained product against shock impacts from all directions will be possible.

The second means for solving the problems of the conventional art is to include in the composition of the packaging structure: a tray pack, made of elastic sheet resin, further comprising a first tray pack and a second tray pack, provided with sustaining portions sustaining the periphery of the contained product; a plate having protrusions/indentations of different sizes and heights, the plate being spaced apart from the above contained product; and a curved surface formed on the outer sides of the tray pack, enabling elastic deformation around said sustaining portions and composed of at least a first curved surface and a second curved surface which extends from the first curved surface. The above tray pack is formed by fitting together the concave and convex engaging portions, at the perimeters of the first tray pack and the second tray pack, so that they face each other to suspend the contained product securely in place. The second means further includes: a box structure composed of a box portion for containing the above tray pack; a lid portion for covering the opening of said box portion, provided with sustaining portions, which suspend the tray pack by coming into contact with the periphery of the tray pack and are placed at the inner sides of the box portion; and contact flaps which come into contact with the upper surface of the contained tray pack, wherein the above contact flaps are able to support the tray pack when the lid portion of the box structure is shut so that the inner surface holds down said contact flaps resulting in their touching the outer surface of the tray pack.

According to the above second means, the tray pack will have the same effects as that described for the first means; however, the box structure which holds the tray pack will also have the effect of protecting the contained product.

Specifically, the sustaining portions placed at the inner side of the box structure sustains the tray pack through partial contact with its outer surface at the sides, which in turn enables effective elastic deformation of the curved surfaces for shock impacts coming from the sides. Thus, an even better shock diffusion effect can be achieved. Further, the contact flaps sustain the tray pack by pressing onto the top surface of the tray pack, and thus the up and down movement of the tray pack can be controlled. Owing to all of the above-described effects, the shock impact values for shock applied to the packaged product from any one of the 6 faces, 9 edges, and 4 corners of the tray pack can be kept below 60G.

DESCRIPTION OF THE PREFERRED EMBODIMENTS

The preferred embodiments and the essential components of the packaging structure, according to the present invention will be described in detail with reference to the accompanying drawings. Note that all throughout the drawings, the same numerical notations will be used to represent identical parts and locations. Furthermore, the circuit unit 1 described in FIG. 26 will represent the packaged product in the following description.

Figure 1:
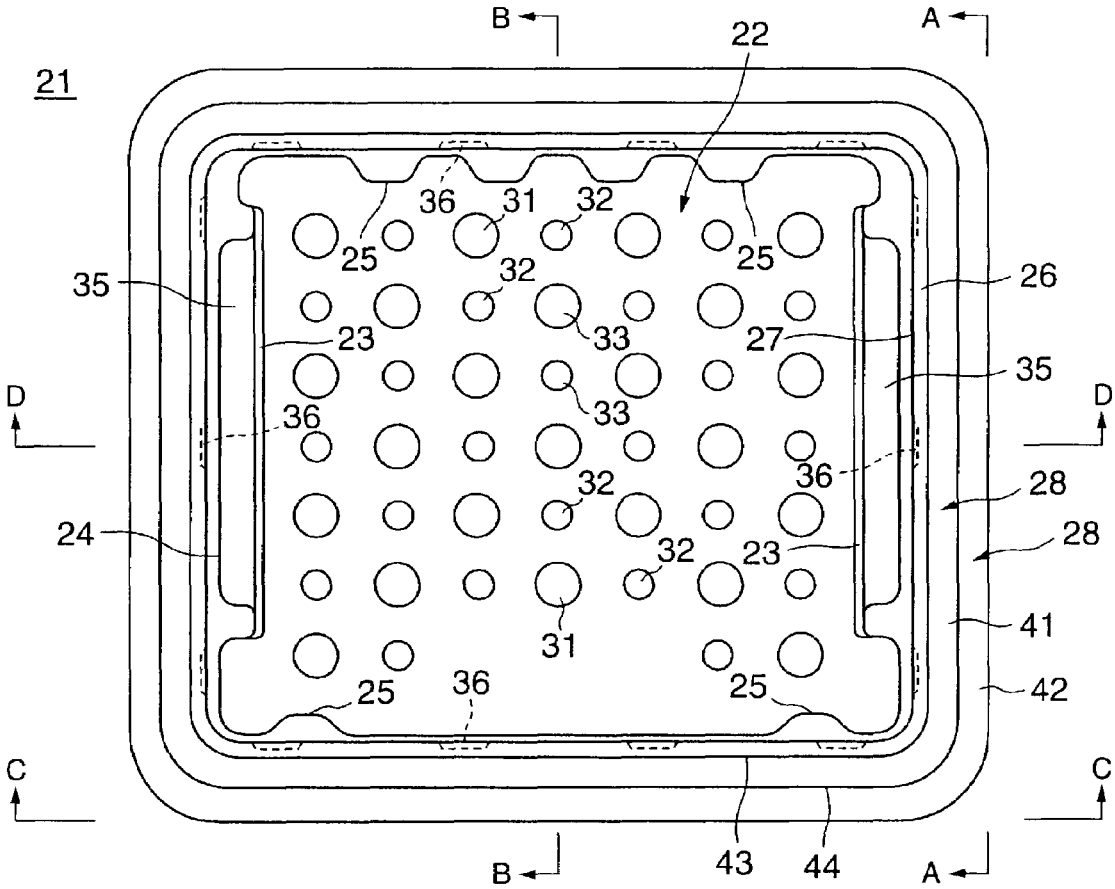
FIG. 1 shows a top view of the first tray pack according to the present invention.
Figure 2A:
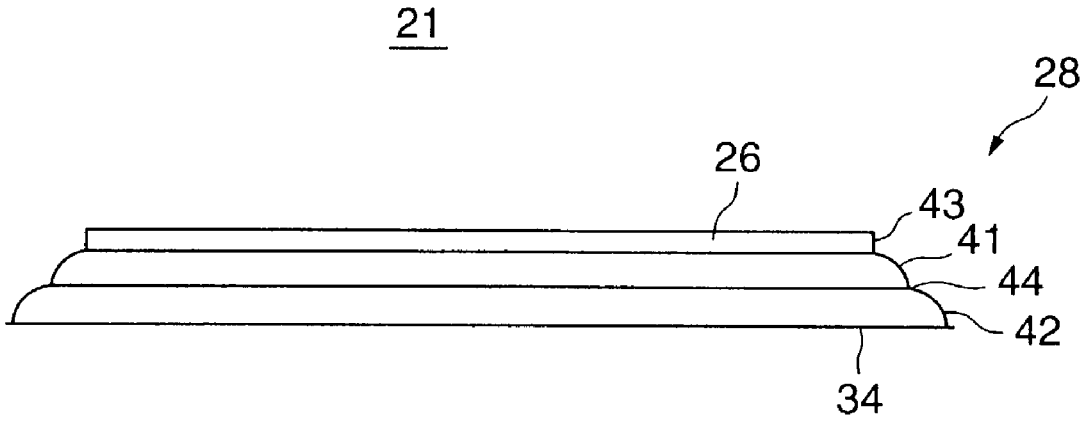
FIGS. 2A–2B respectively show a side view at the A—A line and a cross sectional view cut along the B—B line of the tray pack of FIG. 1.
Figure 2B:
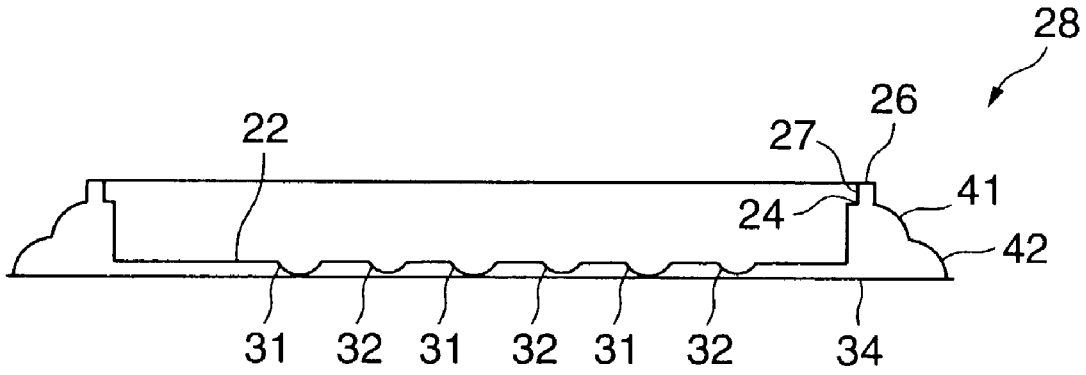
Figure 3A:
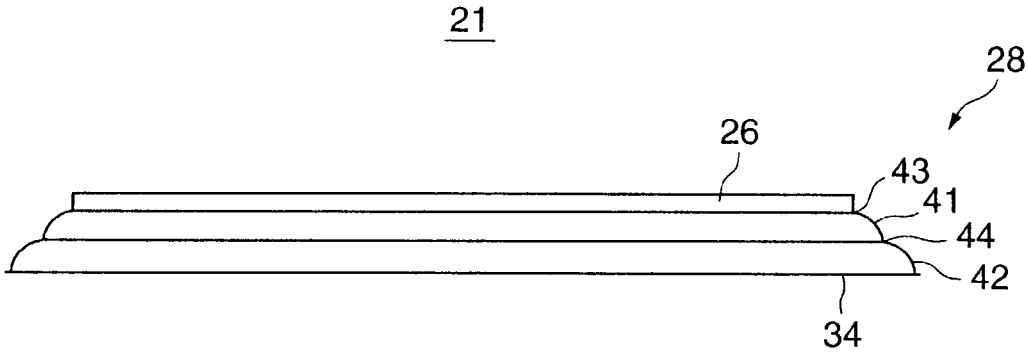
FIGS. 3A–3B respectively show a side view at the C—C line and a cross sectional view cut along the D—D line of the tray pack of FIG. 1.
Figure 3B:
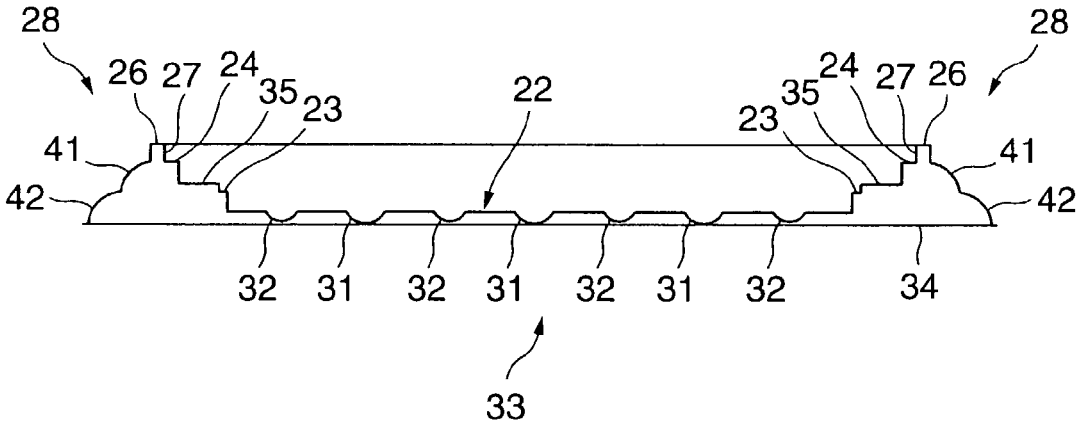
Figure 4A:
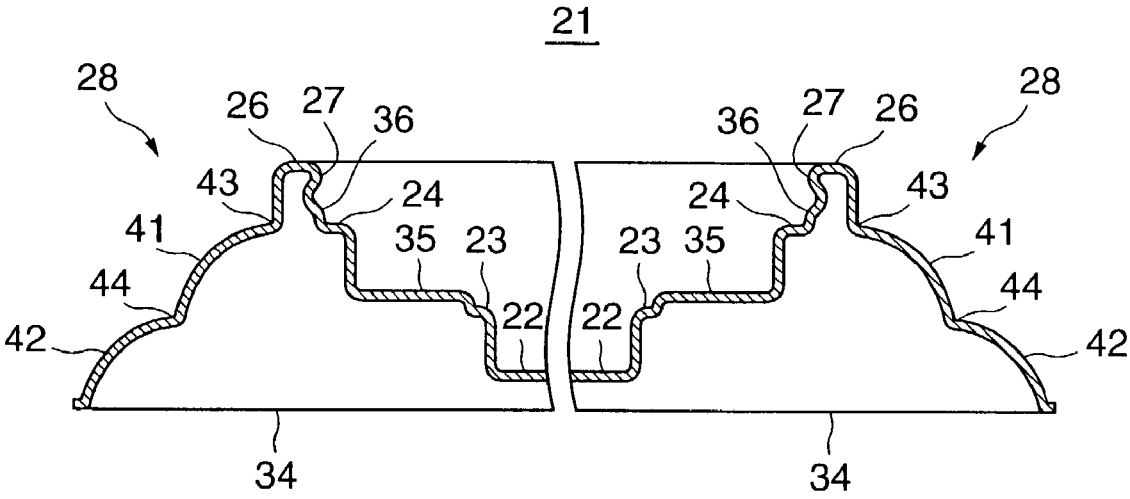
FIGS. 4A–4B respectively show an enlarged view of the left and right hand side parts and center part of FIG. 3 B.
Figure 4B:
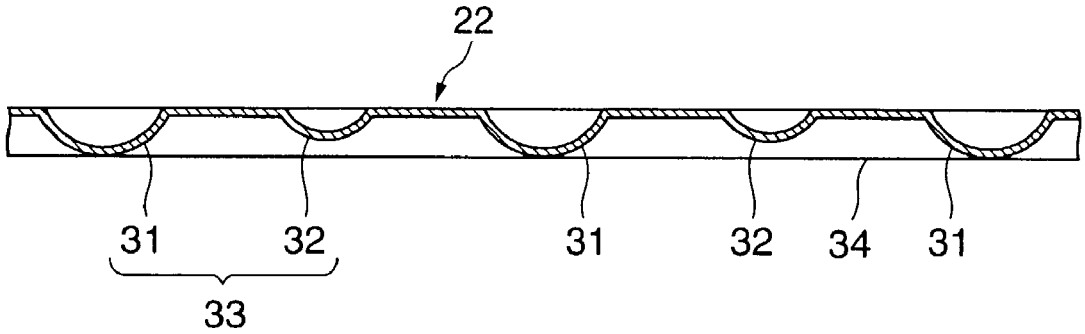

FIG. 1 is a top view of a first tray pack according to the present invention, wherein FIG. 2 A shows a side view of FIG. 1 along line A—A, FIG. 2B a cross sectional view of FIG. 1 across line B—B, FIG. 3A a side view of FIG. 1 along line C—C, FIG. 3B a cross sectional view of FIG. 1 across line D—D, FIG. 4A an enlarged view of the left and right hand side portions of FIG. 3B, FIG. 4B an enlarged view of the center portion of FIG. 3B.

Referring to the above figures, the first tray pack 21 comprises: a plate 22 spreading across the center portion of the tray pack; sustaining portions 23 extending parallel to each other and to the plate 22 at a position one level higher than the plate 22, as shown on the left and right hand sides in FIG. 1; a step portion 24 surrounding the perimeter of the plate 22 at a position still higher than the sustaining portions 23; perpendicular sustaining portions 25 which protrude from a front side and its parallel rear side at the portion in between the level of the plate 22 and the step portion 24 as shown in FIG. 1; an engaging portion 26 protruding upwards so as to surround step portion 24 and its inner side which forms a multi-concave engaging portion 27; and a multi-curved surface 28 surrounding the perimeters of the outer side of the tray pack.

As shown in FIG. 1, first protrusions/indentations 31 large in size (base diameter) and height, and second protrusions/indentations 32 smaller in size (base diameter) and height with respect to the first protrusions/indentations 31, both face outward and are positioned horizontally and vertically on the plate 22 at (regular) intervals, forming a set of protrusions/indentations 33. Both of these protrusions/indentations are spherical surfaces that differ from each other in diameter (radius), wherein the tips of the first protrusions/indentations 31 of the set of protrusions/indentations 33 are arranged so as to touch the plane surface 34 formed by the outer edges of the curved surface 28, and the tips of the second protrusions/indentations 32 are arranged so as to be spaced apart from the plane surface 34 (see FIG. 4B).

The sustaining portions 23 shown at the left and right hand sides of the FIG. 1 each have a designated intermediate step portion 35, which is positioned lower than the step portion 24 and higher than the surface of the sustaining portions 23, as will be described in more detail later on.

The wall surface of the multi-concave engaging portion 27, which is perpendicular to the engaging portion 26, comprise engaging concave portions 36, shown in detail in FIG. 4A, which is longer horizontally along the perimeter and is formed at 14 different locations along the multi-concave engaging portion 27, as indicated by dotted lines in FIG. 1.

The multi-curved surface 28 is formed of multiple curved surfaces along an imaginary slope extending outwards from the outer perimeter of the engaging portion 26, wherein the first curved surface 41 on the upper hand and the second curved surface 42 on the lower hand form consecutive curves, the lower end of the second curved surface 42 being the plane surface 34 as shown in FIG. 4A.

These curved surfaces are arcs with a predetermined radius extending around the perimeter of the tray pack whose 4 corners in the top view of FIG. 1 are curved by forming an arc. Here, the boundary between the engaging portion 26 and the first curved surface 41 is denoted as a first fulcrum 43, and the boundary between the first curved surface 41 and the second curved surface 42 is denoted as a second fulcrum 44, as shown in FIG. 4A.

The above-described first tray pack 21 is formed of a relatively thin sheet as is apparent from FIG. 4, as for its material, synthetic resin having both elasticity and appropriate rigidity for resisting shock such as ABS resin, high impact polystyrene (HIPS) resin, or any other synthetic resin may be selected for use. The tray pack is typically manufactured by means of a vacuum molding method using a molding cast. Also, this first tray pack 21 can be transparent so that the condition of the packaged product contained within could easily be inspected.

It should be noted that the above cross sectional views show only the contour lines of the cut section since illustrating the configuration of the inner section in between the upper most surface and the lower most surface will complicate the description.

Figure 5:
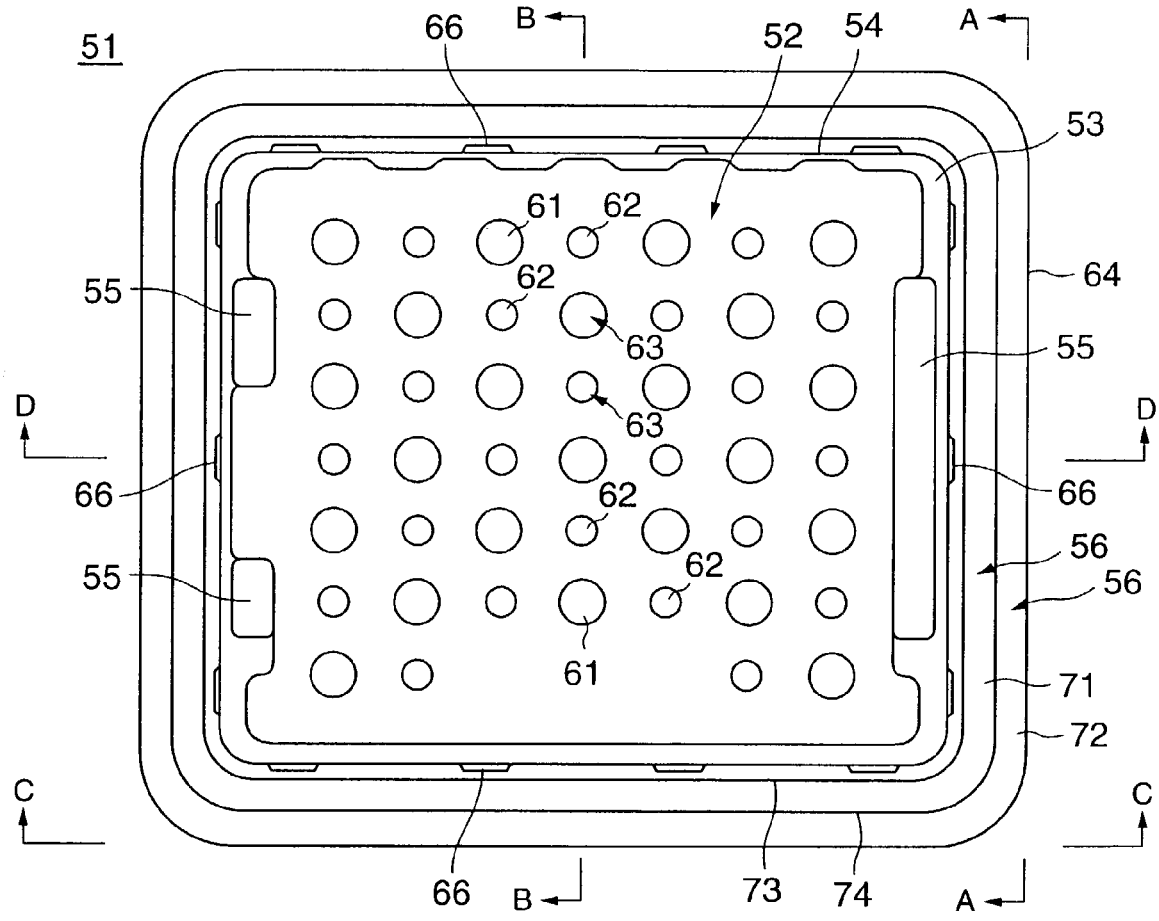
FIG. 5 shows a top view of the second tray pack according to the present invention.
Figure 6A:
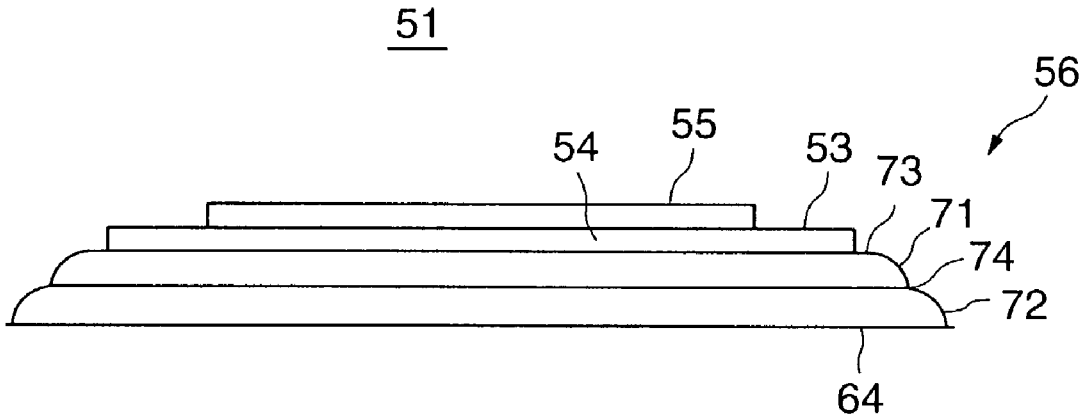
FIGS. 6A–6B respectively show a side view at the A—A line and a cross sectional view cut along the B—B line of the tray pack of FIG. 5.
Figure 6B:
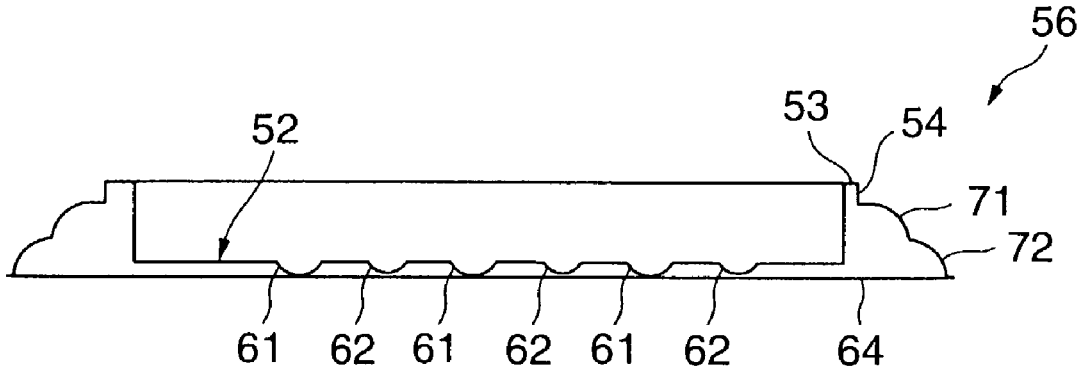
Figure 7A:
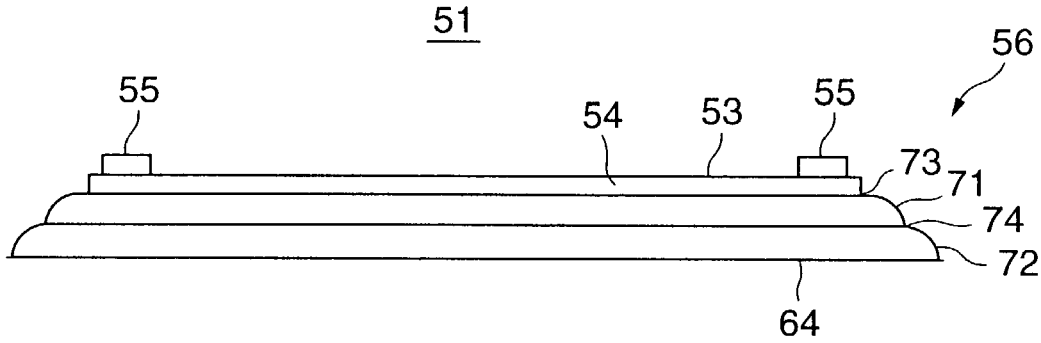
FIGS. 7A–7B respectively show a side view at the C—C line and a cross sectional view cut along the D—D line of the tray pack of FIG. 5.
Figure 7B:
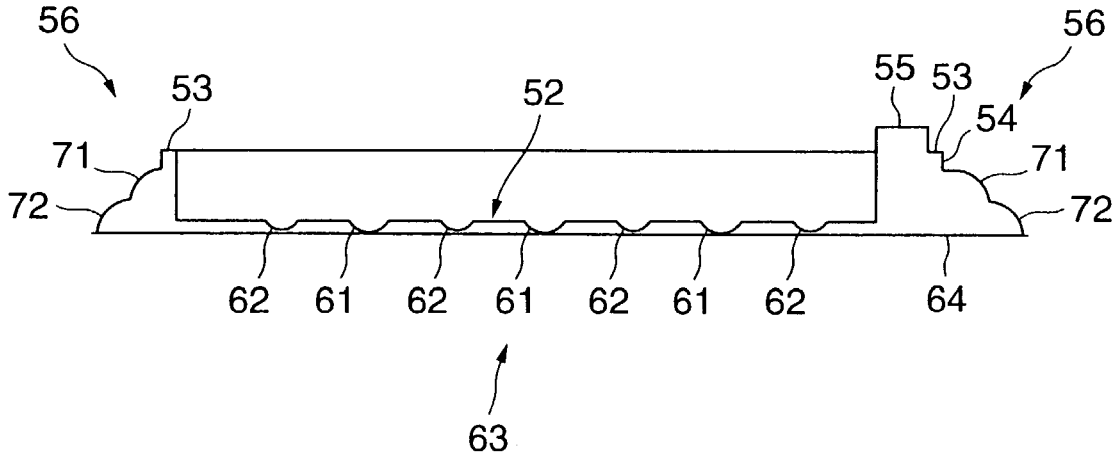
Figure 8A:
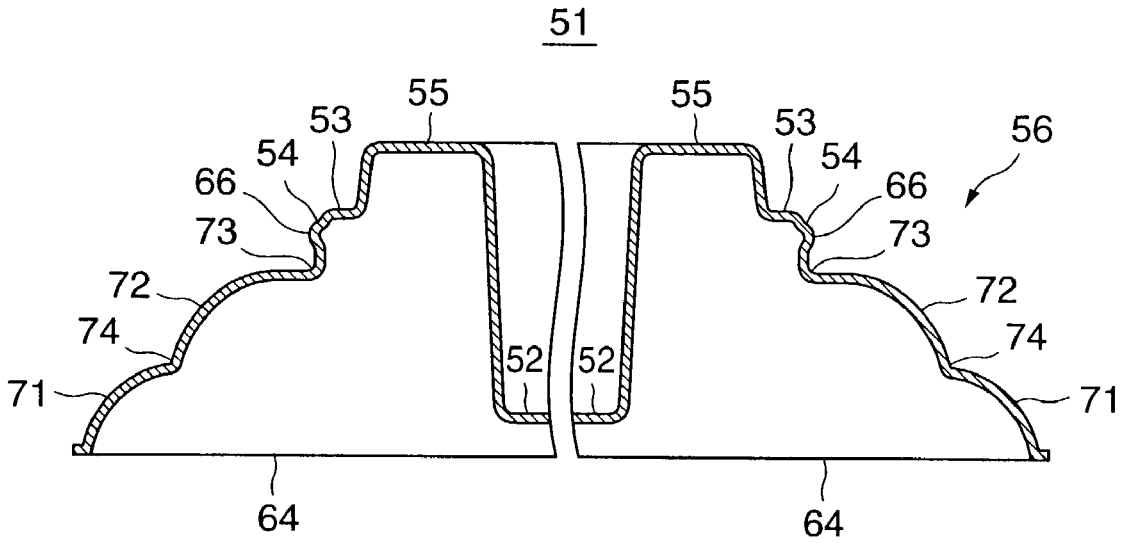
FIGS. 8A–8B respectively show an enlarged cross sectional view of the essential parts of the left and right hand sides and center part of FIG. 7A.
Figure 8B:
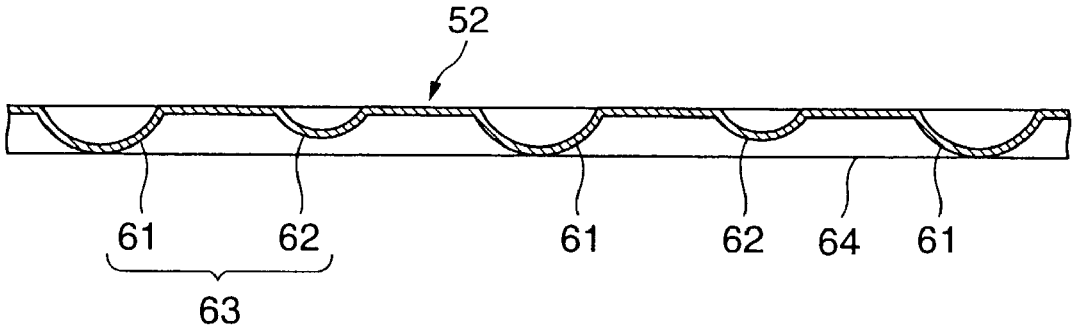

FIG. 5 shows a top view of a second tray pack 51 viewed from the inside wherein FIG. 6A shows a side view of FIG. 5 along line A—A, FIG. 6B a cross sectional view of FIG. 5 across line B—B, FIG. 7A a side view of FIG. 5 along line C—C, FIG. 7B a cross sectional view of FIG. 5 across line D—D, FIG. 8A an enlarged view of the left and right hand side portions of FIG. 7B, FIG. 8B an enlarged view of the center portion of FIG. 7B.

Referring to the above figures, the second tray pack 51 comprises: a plate 52 spread across the center portion of the tray pack; a raised engaging portion 53 surrounding the perimeters of the plate 52 and its outer side which forms a multi-convex engaging portion 54; sustaining portions 55 formed on a step parallel to the left and right hand sides of FIG. 5 and at one level higher than the engaging portion 53; and a multi-curved surface 56 surrounding the perimeters of the outer side.

As shown in FIG. 5, first protrusions/indentations 61 large in size and height, and second protrusions/indentations 62 smaller in size and height with respect to the first protrusions/indentations 61, both face outwards and are positioned horizontally and vertically on the plate 52 at (regular) intervals, forming a set of protrusions/indentations 63. Both of these protrusions/indentations are spherical surfaces that differ from each other in diameter (radius), wherein the tips of the first protrusions/indentations 61 of the set of protrusions/indentations 63 are arranged so as to touch the plane surface 64 formed by the outer edges of the curved surface 56, and the tips of the second protrusions/indentations 62 are arranged so as to have some space between the plane surface 64 (see FIG. 8B).

The wall surface of the multi-convex engaging portion 54 which is perpendicular to the engaging portion 53 has engaging convex portions 66 shown in detail in FIG. 8A which is longer horizontally along the perimeter and is formed at 14 different locations along the frame as indicated by solid lines in FIG. 5.

The multi-curved surface 56 is formed of multiple curved surfaces along an imaginary slope extending outwards from the outer perimeter of the engaging portion 53, wherein the first curved surface 71 on the upper hand and the second curved surface 72 on the lower hand form consecutive curves, the lower end of the second curved surface 72 forming the plane surface 64 as shown in FIG. 8A.

These curved surfaces are arcs with a predetermined radius extending around the perimeter of the tray pack whose 4 corners in the top view of FIG. 5 are curved by forming an arc. Here, the boundary between the engaging portion 53 and the first curved surface 71 is denoted as a first fulcrum 73, and the boundary between the first curved surface 71 and the second curved surface 72 is denoted as a second fulcrum 74, as shown in FIG. 8A.

The above-described second tray pack 51 also is formed of a relatively thin sheet like the first tray pack 21. As for its material, synthetic resin having both elasticity and appropriate rigidity for resisting shock such as ABS resin, high impact polystyrene (HIPS) resin, or any other synthetic resin may be selected for use. The tray pack is typically manufactured by means of a vacuum molding method using a molding cast. This second tray pack 51 can also be transparent so that the condition of the packaged product contained within could easily be inspected.

It should be noted that the above cross sectional views also show only the contour lines of the cut section since illustrating the configuration of the inner section in between the upper most surface and the lower most surface will complicate the description.

Figure 9A:
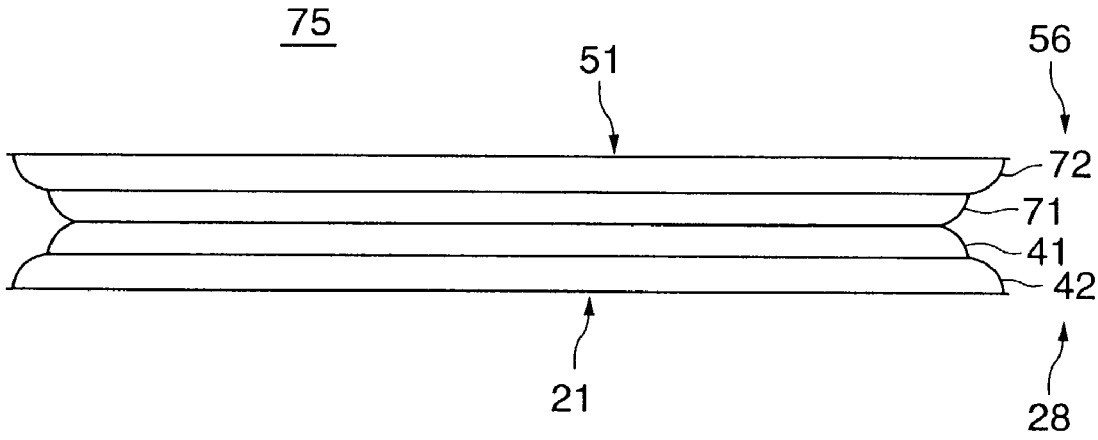
FIGS. 9A–9B respectively show a side view of the first tray pack and the second tray pack adjoined together.
Figure 9B:
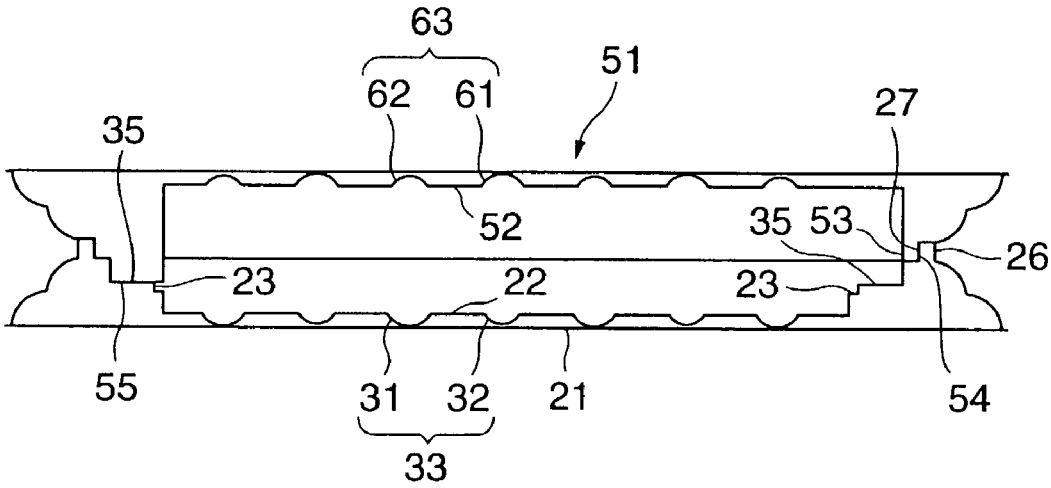

FIG. 9 is an illustration of the first tray pack 21 being joined together by the second tray pack 51 wherein FIG. 9A shows a side view and FIG. 9B shows a cross sectional view. In this figure, the first tray pack 21 is identical to that of FIG. 3B, and the second tray pack 51 corresponds to the tray shown in FIG. 7B but turned upside down.

Thus, the shapes and dimensions of these trays are arranged so as to be joined together as shown in this figure by fitting the multi-convex engaging portion 54 of the outer perimeter of the engaging portion 53 of the tray pack 51 to the multi-concave engaging portion 27 of the inside perimeter of the engaging portion 26 of the first tray pack 21.

This also means that the sustaining portions 55 of the second tray pack 51 will be adjoined to the intermediate step portions 35 of the first tray pack 21, and that the surface of the sustaining portions 55 of the second tray pack 51 will cover the section of the sustaining portions 23 of the first tray pack 21.

Also, although not shown in the figures, when the multi-convex engaging portion 54 is fit into the multi-concave engaging portion 27, all of the engaging concave portions 36 along the perimeter of the multi-concave engaging portion 27 and the engaging convex portions 66 of the multi-convex engaging portion 54 will be engaged and fit together through elastic deformation due to their concavity and convexity. When these portions recover to their original forms, the tray packs will not to be separated from each other by themselves. However, it will be possible to pull them apart from one another. The pair of tray packs thus assembled together is denoted by the numeral 75 hereinafter (see FIG. 9A).

Figure 10:
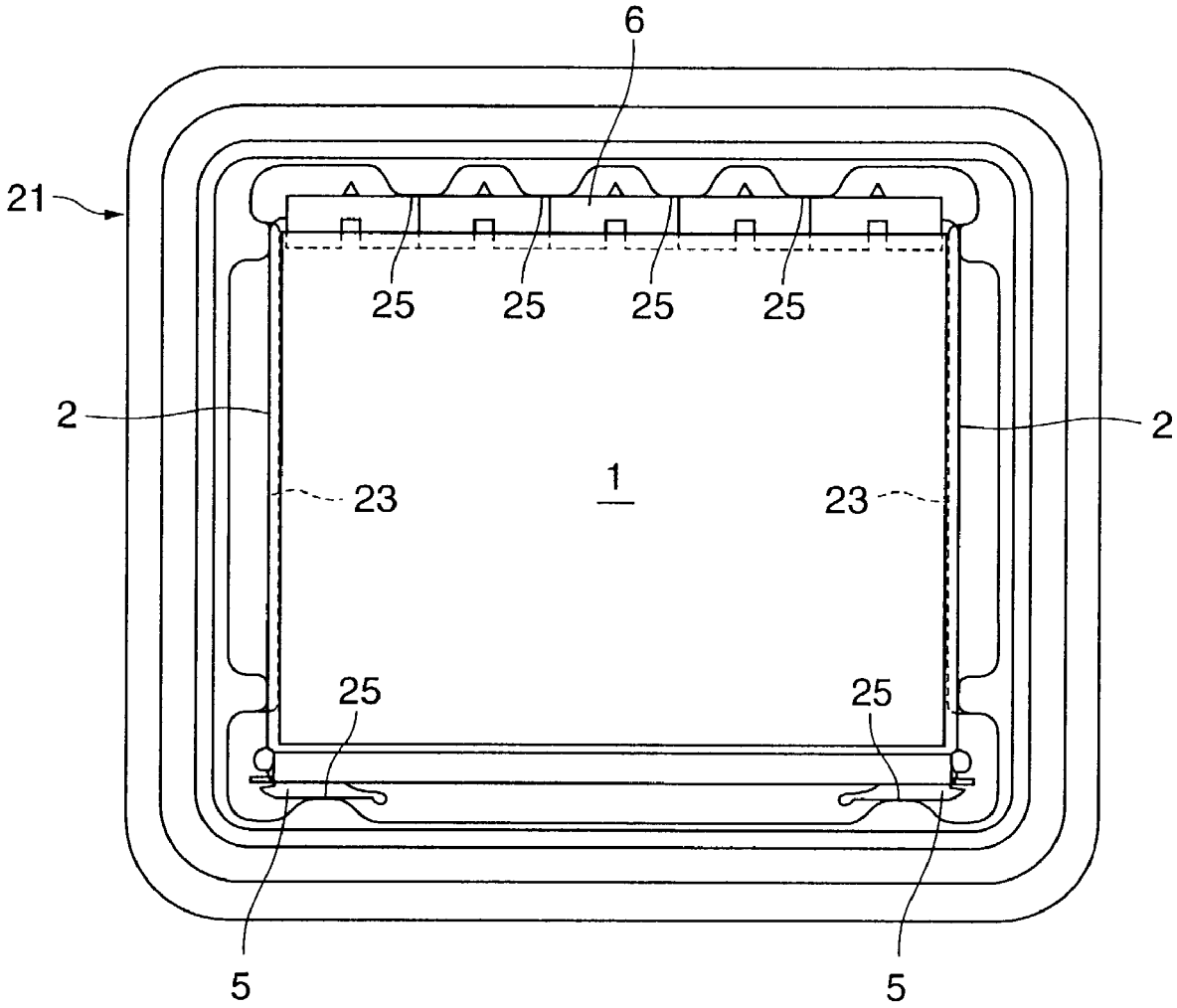
FIG. 10 shows a top view of the first tray pack having a circuit unit contained therein.
Figure 26B:
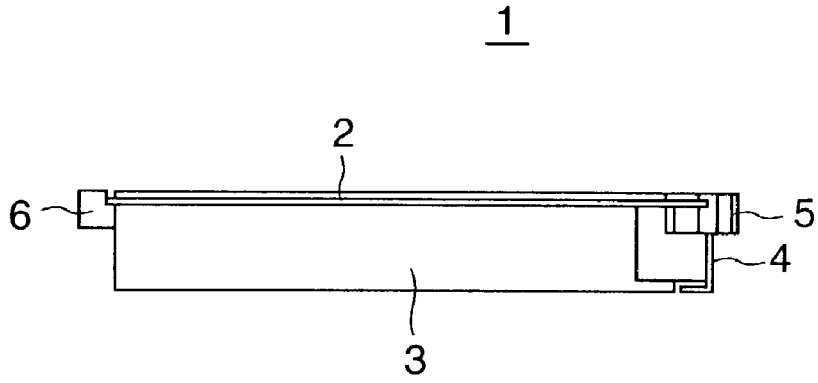
FIG. 26A–26C show outline views of the circuit unit as the product contained within the present invention.
Figure 26A:
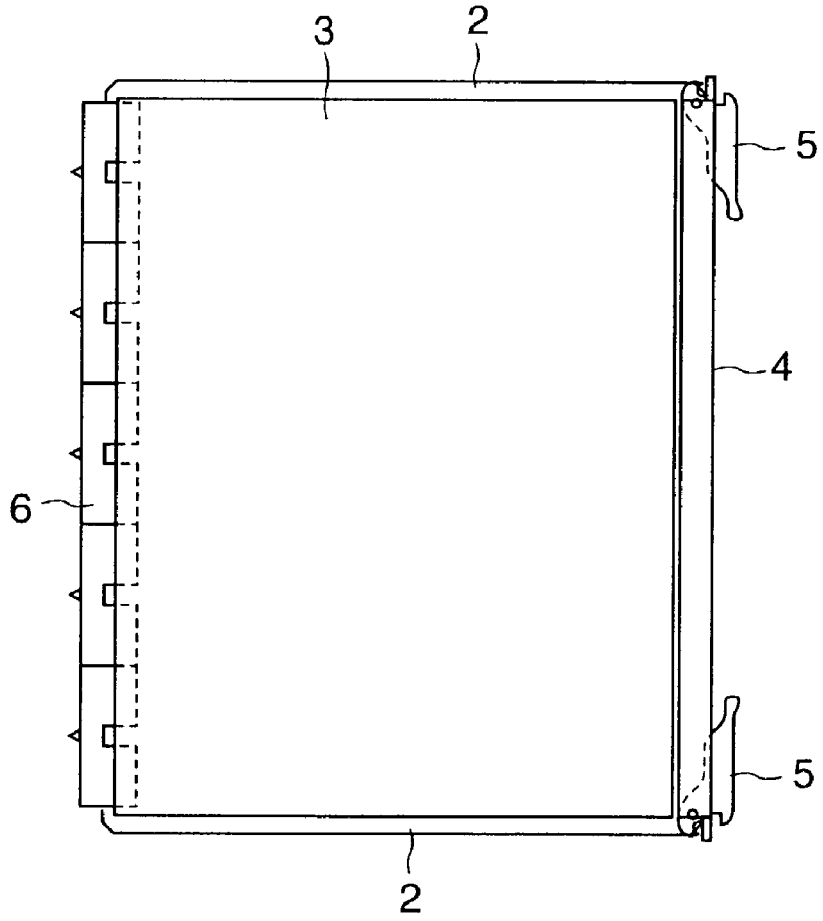
Figure 26C:
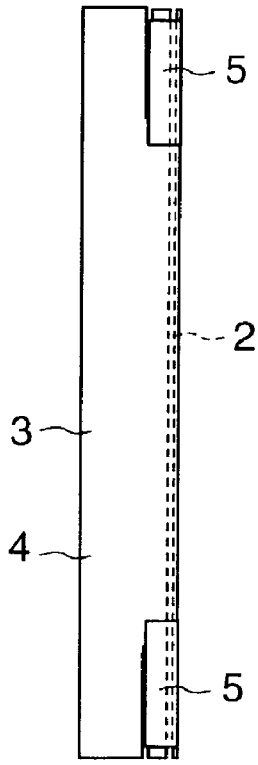

FIG. 10 is a top view of the first tray pack 21 wherein the circuit unit 1 shown in FIG. 26 representing the packaged product, is fit into and contained within the tray pack. The exposed portions of the printed wiring board 2, at both sides of the circuit unit 1, are laid onto and supported by the sustaining portions 23, and the front surfaces of the plug fittings 5 at the two ends of the front side come into contact with the perpendicular sustaining portions 25. Similarly, the surface of each of the connectors 6 on the back side also comes in contact with the perpendicular sustaining portions 25.

Fitting the printed wiring board 2 to the sustaining portions 23 will prevent the unit from being moved from side to side with respect to the figure. Similarly, putting the plug fittings 5 and the connectors 6 into contact with the perpendicular sustaining portions 25 will prevent the unit from moving back and forth; thus, the unit will be restrained from moving in any direction and in turn will be held securely in place.

Figure 11:
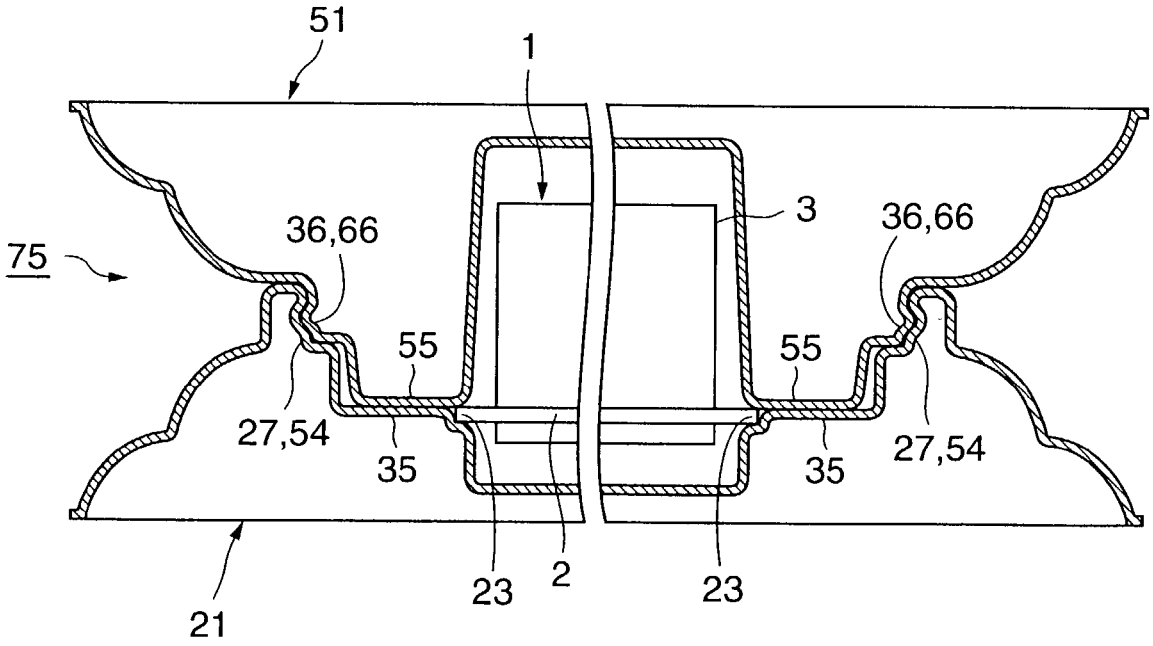
FIG. 11 shows cross sectional views of the essential parts of the tray pack having a circuit unit contained within.

In this context, fitting together and adjoining the second tray pack 51 to the first tray pack 21 as shown in FIG. 9 will result in a joined package structure as shown in FIG. 9B or in FIG. 11 where the essential parts of the cross sectional views are shown in greater detail. Thus, the surface of the printed wiring board 2 is secured in between the sustaining portions 23 of the first tray pack 21 and the sustaining portions 55 of the second tray pack 51, preventing the unit from moving up and down, and the circuit unit 1 will be held in place by the tray pack 75 and will be kept from moving in any direction. Note that the shield cover 3 does not touch any part of the second tray pack 51 as indicated in the drawing.

Figure 12:
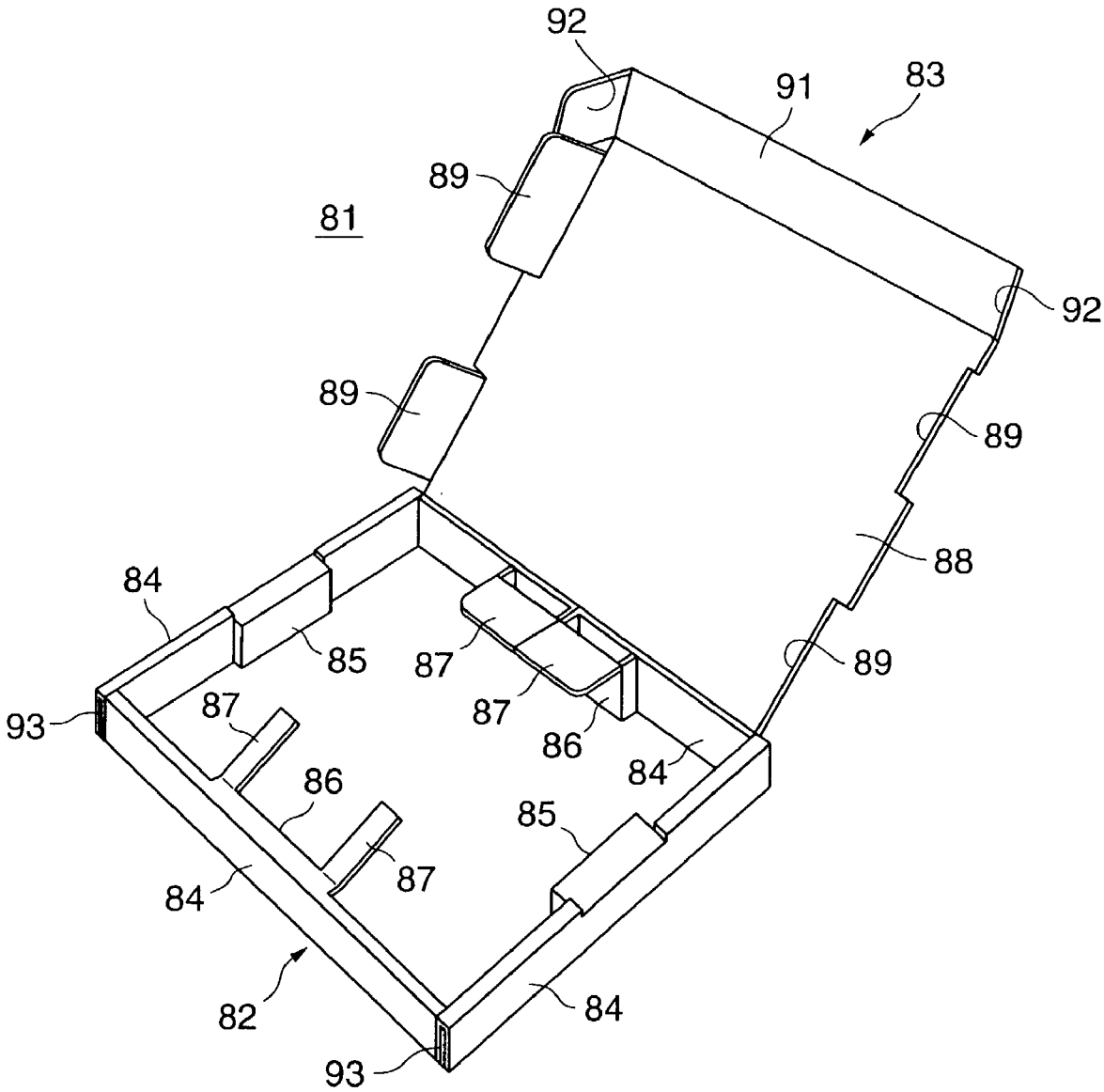
FIG. 12 shows a perspective view of a box.
Figure 13:
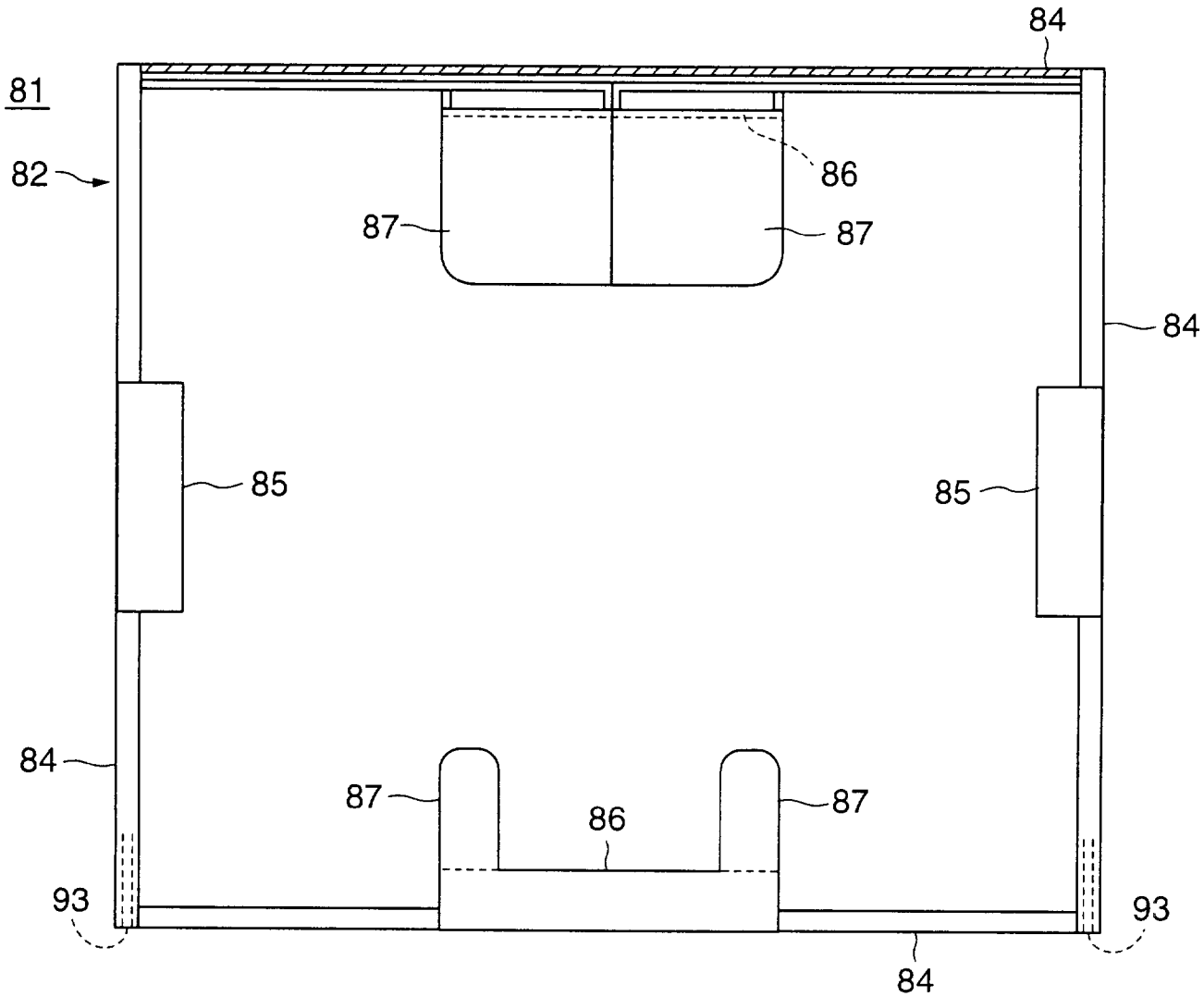
FIG. 13 shows a top view of the box alone.

FIG. 12 is a perspective view of a box structure 81 which holds the tray pack 75, wherein the lid portion 83 is opened to reveal the inside of box portion 82. FIG. 13 is a top view showing only the box portion 82. The whole box structure 81 is made out of one piece of cardboard material processed, folded, connected and consolidated into one structure. When unfolded, all the parts of this structure will extend on one contiguous material.

The side walls 84 surrounding the perimeter of the box portion 82 are double layered so that they are equipped with sufficient durability to bear both the load coming from compression and the load coming from the sides.

At the center portions of the left and right hand side walls in the drawing, first flared walls 85 are positioned face to face and opposing each other. Similarly, at the center portions of the front and rear side walls 84, second flared walls 86 are formed, each of the walls 86 being a part of a sustaining portion. The second flared wall 86 on the front side has contact flaps 87 which can be folded along the dotted lines that are indicated in FIG. 13 and can either be parallel to or can stand upon the bottom surface.

The lid portion 83 is comprised of a top surface 88 which covers the upper opening of the box portion 82, side boards 89 situated at the two sides which are folded down avoiding the area of the flared walls 85, a front board 91 which is extended from the front edge of the top surface and folded downwards, latch flaps 92 which stick out from both sides of the front board 91 and are also folded.

The lid portion 83 is linked to the box portion 82 at one of its side edges and by folding this down, the upper opening of the box portion 82 will be covered, the side boards 89 will be placed at the inner side of the of the left and right hand side walls of the box portion 82, and the front board 91 will be placed at the outer side of the front side wall of the box portion 82, thus the top surface 88 will be inserted in between the two opposing sides of the box portion 82 to become the equivalent of a top surface wall of the box portion 82 and the portions of the top surface 88 in between the side boards 89 will come in contact with the upper surface of the first flared walls 85.

Upon folding down the front board 91, the latch flaps 92 are inserted and engaged into openings 93 in between the layers of the double-layered walls formed at the two sides of the front side wall of the box, and thus the front board 91 will be fastened to the box portion 82 and the front board 91 will have to be pulled out to be opened hindering it from opening up on its own.

Figure 14:
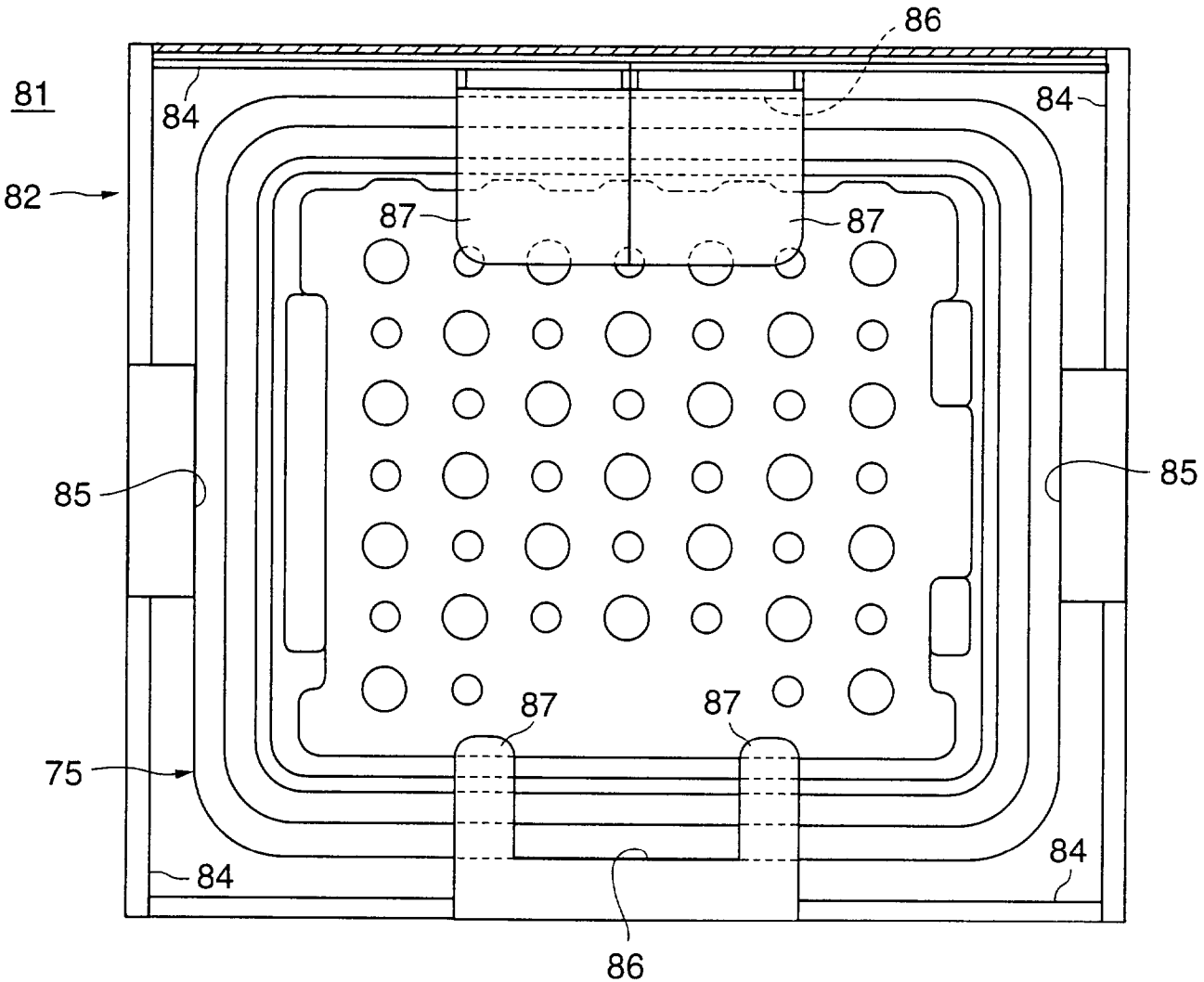
FIG. 14 shows a top view of the box having a circuit unit contained within.

FIG. 14 is a top view of the box portion 82 which holds the tray pack 75 in the state as described in FIG. 11 with the circuit unit 1 contained inside as the packaged product. The perimeter of tray pack 75 is held in place by fitting into and coming into contact with the sustaining portion comprised of first flared walls 85 and second flared walls 86. Places other than these four sections do not touch the inner sides of the walls 84 surrounding the box portion 82; namely, the four remaining corner portions of the tray pack 75 remain intact by maintaining a distance from the walls of the box. Also, the contact flaps 87, extending from the second flared walls 86, are placed so as to cover the upper surface of the perimeter of the second tray pack 51.

Figure 15:
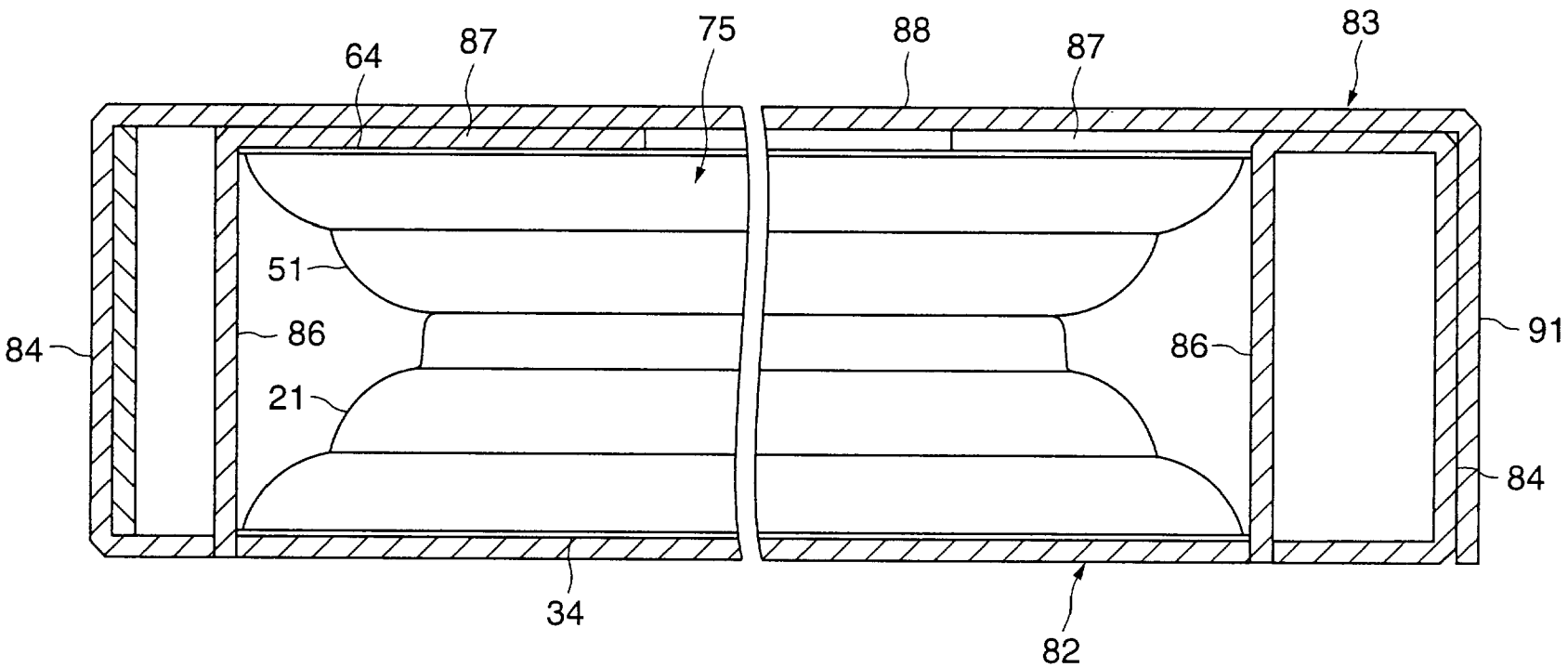
FIG. 15 shows a cross sectional view of the essential parts of the box with the circuit unit contained therein.

FIG. 15 is a cross sectional side view of the box structure 81 cut at the second flared walls 86, wherein the tray pack 75 is contained in the box portion 82 with the lid portion 83 covering its top portion as described above. The periphery bottom surface 34 of the first tray pack 21 comes into contact with the inner bottom surface of the box portion 82, and the periphery top surface 64 of the second tray pack 51 comes into contact with the contact flaps 87, which are held down by the top surface 88.

The two sides of both the periphery bottom surface 34 of the first tray pack 21 and the periphery top surface 64 of the second tray pack 51 come into contact with the sustaining portions (the inner surface of the second flared walls 86) which hold the tray pack 75 in place, as shown in this figure as well as in FIG. 14. The same arrangement also applies to the inner sustaining portions of the flared walls 85; therefore, the tray pack 75 would be kept from moving around in any direction inside the box structure 81.

In the following, the function of each of the parts of the present invention with respect to the above-described arrangement will be explained with reference to the accompanying drawings.

First, a description of the function of the set of protrusions/indentations 33 (see FIG. 1) will be given by referring to FIG. 16. In the descriptions of the first tray pack 21 and the second tray pack 51 the set of protrusions/indentations included protrusions/indentations of two different sizes; however, in this drawing, the description is given with reference to a set of protrusions/indentations, TYPE 0, having protrusions/indentations of three different sizes and heights A, B, and C. Specifically, the protrusions/indentations of the set are a combination of the largest and tallest protrusions/indentations A, the smallest and shortest protrusions/indentations C, and the protrusions/indentations B between A and C in size and height.

Figure 16A:
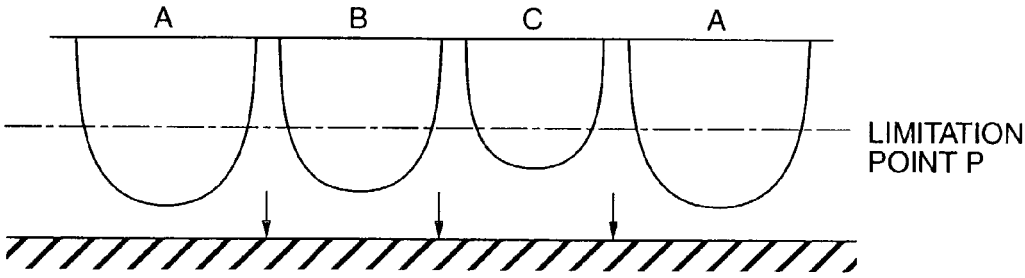
FIGS. 16A–16D are illustrative diagrams showing the effects of the protrusions/indentations according to the present invention.
Figure 16B:
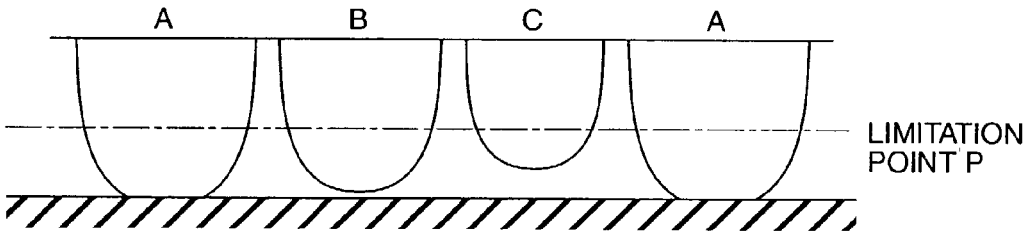
Figure 16C:
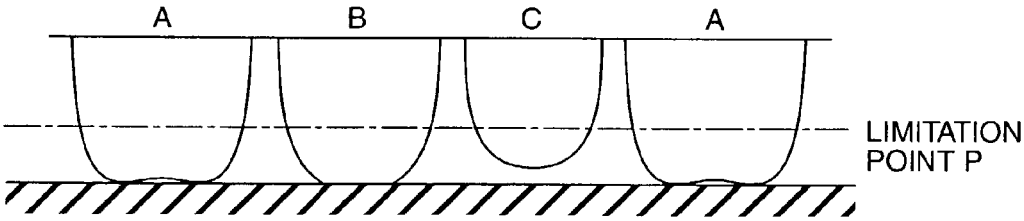

These protrusions/indentations A, B and C are arranged so that they will not change its shape beyond a limitation point P. As shown in FIG. 16B, the tips of the protrusions/indentations A first touch the surface upon receiving a shock impact, and as the shock is administered to the surface, it is absorbed by the elastic compression deformation of the protrusions/indentations A. Then, in FIG. 16C, the tips of the protrusions/indentations B touch the surface and absorb the shock impact along with the protrusions/indentations A, also through elastic compression deformation.

Figure 16D:
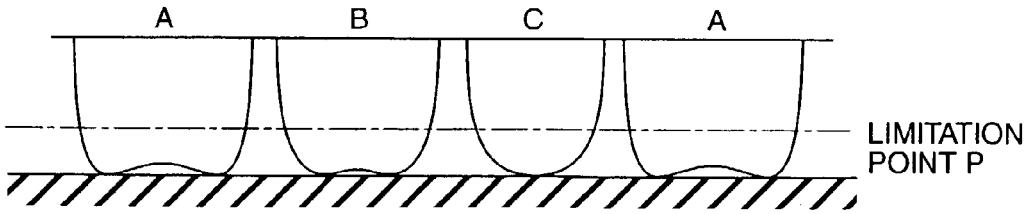

Further, in FIG. 16D, the protrusions/indentations C also touch the surface upon receiving the shock impact; however, since the protrusions/indentations C are smaller in size compared to the protrusions/indentations A and B, they are provided with a certain amount of physical rigidity and will have an effect of bouncing back from the surface upon receiving the shock impact without much deformation. When deformation reaches point P, the shock impact on the contained product will be big; thus, the limitation point P is set and the protrusions/indentations C are given an appropriate reaction function based on its size in order to prevent the shock from reaching point P. Also, with the phased increase in the contact area of the protrusions/indentations, the shock impact to the contained product will be distributed out and controlled. These effects can also be found in the previously mentioned sets of protrusions/indentations 33 and 63.

Figure 17A:
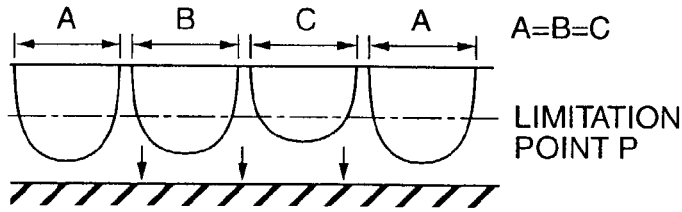
FIGS. 17A–17C are illustrative diagrams showing the effects of the protruding structure according to an embodiment different from the present invention (part 1)

In order to prove the effectiveness of the embodiment shown in FIG. 16, other different embodiments will be compared with the embodiments of the present invention. First, in FIG. 17 when the size of the protrusions/indentations A, B, and C are all equal and B is set to be shorter than A, and C is set to be shorter than B, as shown in FIG. 17A, this embodiment being denoted as TYPE 1, the limitation point could be easily reached upon shock administration due to the fact that there is no difference in the degree of rigidity between each of the different protrusions/indentations thus causing their simultaneous deformation as shown in FIG B. Also, as shown in the comparison graph of the difference in shock impact values between TYPE 1 and TYPE 0 in FIG. C, TYPE 1 lacks the ability to diffuse the shock impacts and is therefore unsuitable for use in containing the likes of circuit unit 1.

Figure 17B:
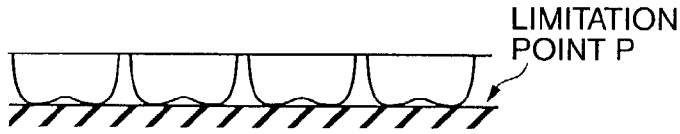
Figure 17C:
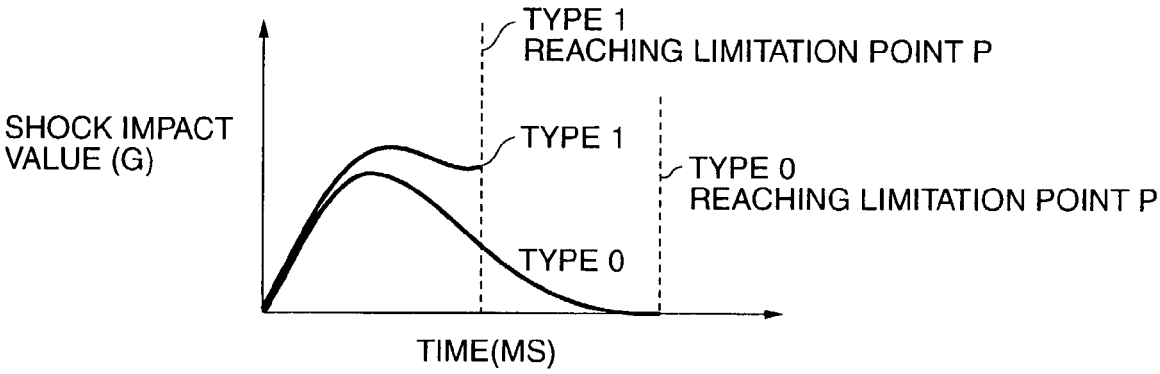
Figure 18A:
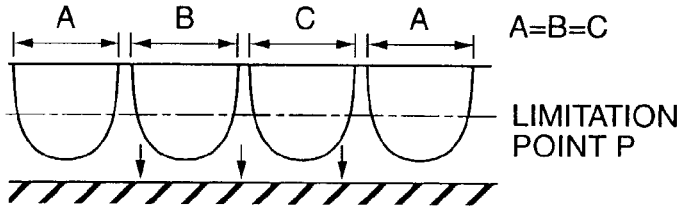
FIGS. 18A–18C are illustrative diagrams showing the effects of the protruding structure according to an embodiment different from the present invention (part 2)
Figure 18B:
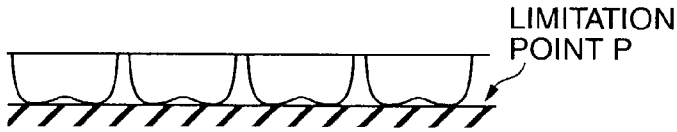
Figure 18C:
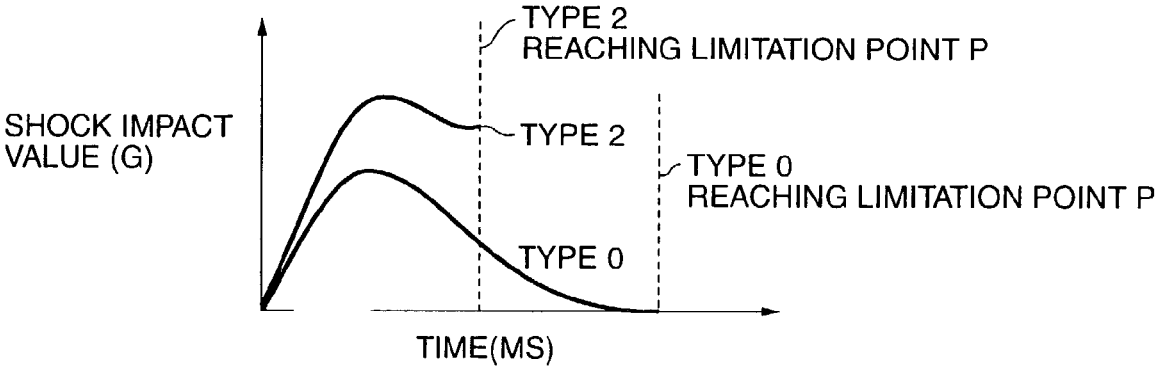

Next, in FIG. 18 when the size as well as the height of the protrusions/indentations A, B, and C are all equal as shown in FIG. A, this embodiment being denoted as TYPE 2, the effects from shock administration will be the same as that described in FIG. 17 plus, the contact moment to the surface of the protrusions/indentations A, B, and C will be simultaneous as well causing them to reach their limitation points simultaneously, as shown in FIG. 18B. Thus, the difference between the shock impact values in TYPE 0 and TYPE 2 will be even greater as shown in the comparison graph in FIG. 18C.

Figure 19A:
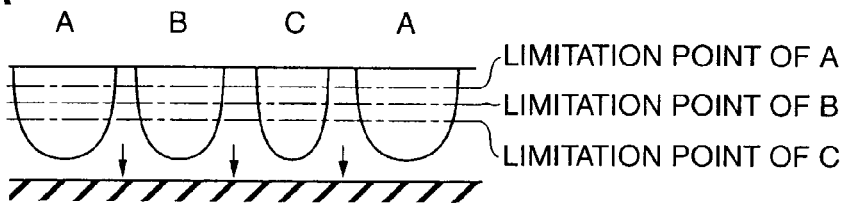
FIGS. 19A–19C are illustrative diagrams showing the effects of the protruding structure according to an embodiment different from the present invention (part 3)
Figure 19B:
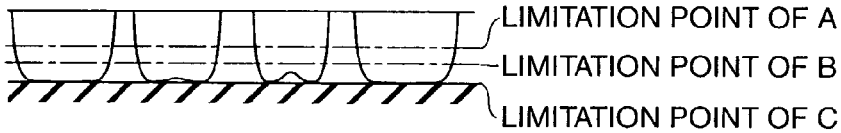
Figure 19C:
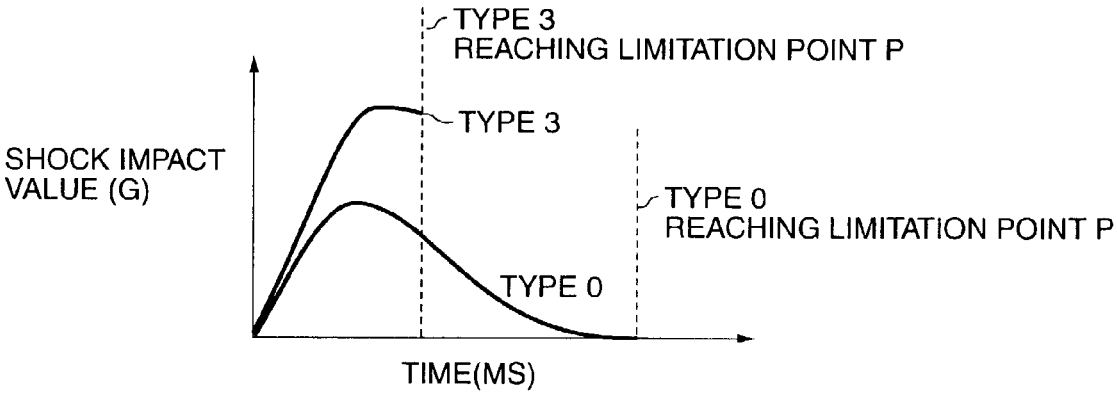

Further, in FIG. 19 when protrusions/indentations A, B, and C are arranged so that protrusions/indentations A are the largest, B being smaller than A, and C being smaller than B, and their heights are all equal as shown in FIG. 19A, this embodiment being denoted as TYPE 3, the deformation of the set of protrusions/indentations will be determined by the limitation point C of the protrusions/indentations C having the highest degree of rigidity which results in a deformation shown in FIG. 19B. Thus, the shock impact value directed towards the contained product will be even higher as shown in the comparison graph of FIG. 19C.

Figure 20A:
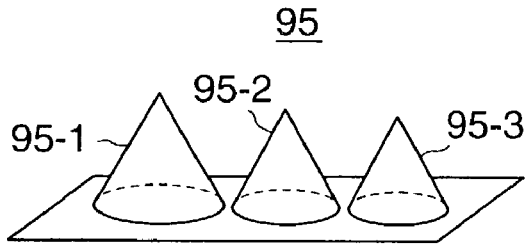
FIGS. 20A–20C show perspective views of different embodiments of the protruding structures of the present invention.
Figure 20B:
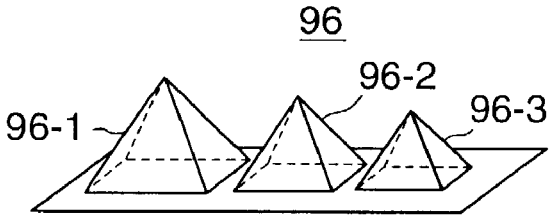
Figure 20C:
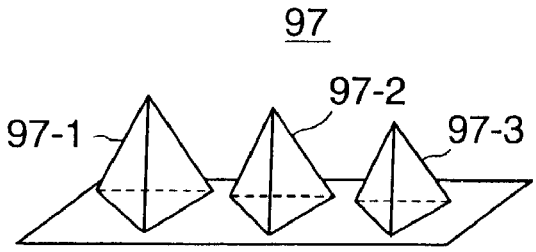

Moreover, embodiments other than the previously mentioned sets of sphere-shaped protrusions/indentations 33 and 63, and the set of protrusions/indentations A, B, and C as shown in FIG. 16 can be used in the present invention. For example, a set of cone-shaped protrusions/indentations 95 composed of cone-shaped protrusions/indentations 95-1, 95-2, 95-3 as shown in FIG. 20 A, a set of quadrangular-pyramid-shaped protrusions/indentations 96 composed of quadrangular-pyramid-shaped protrusions/indentations 96-1, 96-2, 96-3 as shown in FIG. B, a set of triangular-pyramid-shaped protrusions/indentations 97 composed of triangular-pyramid-shaped protrusions/indentations 97-1, 97-2, 97-3, wherein the tips of each of the protrusions/indentations make point contact and the protrusions/indentations change in size and height at different stages so that deformation would not occur beyond limitation point P, can possibly be used. Also, although not shown in the drawings, a set of protrusions/indentations composed of other shapes such as ellipsoidal or parabolic shapes, multi-angular pyramid shapes, etc., may be used, and the number of different protrusions/indentations does not necessarily have to be two or three. Moreover, better effects of distributing out the shock impacts may be achieved by increasing the number of different protrusions/indentations so as to increase the stages of deformation.

The above description concerns the functions of the set of protrusions/indentations. In the following, a description of the functions of the curved surfaces 28 and 56 will be given with reference to FIG. 21 and 22 showing cross sectional views of the essential parts of the curved surfaces 28 of tray pack 21, without the contained product, as an exemplary illustration.

Figure 21A:
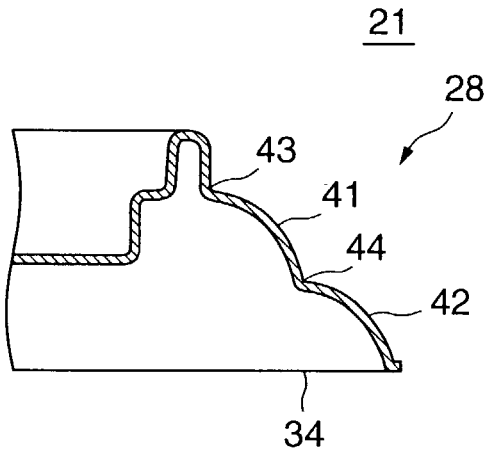
FIGS. 21A–21B are illustrative drawings showing the effects of the plurality of curved surfaces of the present invention (part 1)
Figure 21B:
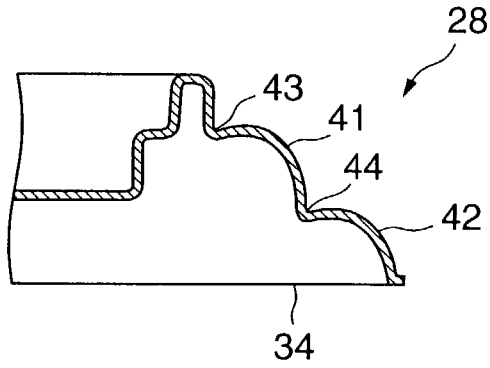

FIG. 21 A shows the state of the curved surface in which the shock impact is not administered. When the shock impact is administered from the direction of the periphery bottom surface 34, the bottom surface will momentarily be in a raised position with respect to FIG. 21A as shown in FIG. 21B. The curve rate of the curve between the first fulcrum 43 and the second fulcrum 44 of the first curved surface changes so that the curve is more articulated and the radius of the curve decreases. Similarly, the curve rate of the curve between the second fulcrum 44 and the periphery bottom surface 34 of the second curved surface 42 changes so that the curve is more articulated and the radius of the curve decreases.

These deformations occur partly due to the fact that the tray pack 75 is contained in the box structure 81 and each of the center portions of the periphery bottom surface 34 and the periphery surface 64 are held in place by the first flared walls 85 and the sustaining portion walls which are the second flared walls 86 so that the deformation can be controlled from spreading around the periphery of the tray pack. The deformations occur at the moment of the shock impact and they recover in a short period of time according to the damped vibrations of the shock impact. The elastic deformation thus achieved is nothing short of being the very mechanism for diffusing the shock impact cast upon the contained product 1.

Figure 22A:
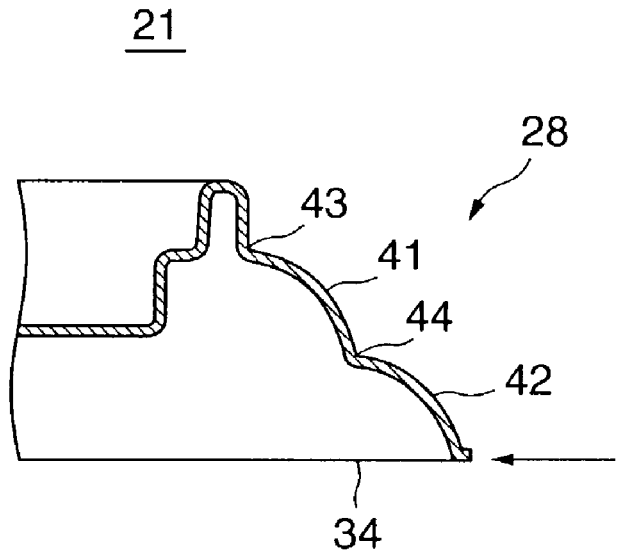
FIG. 22A–22B are illustrative drawings showing the effects of the plurality of curved surfaces of the present invention (part 2).
Figure 22B:
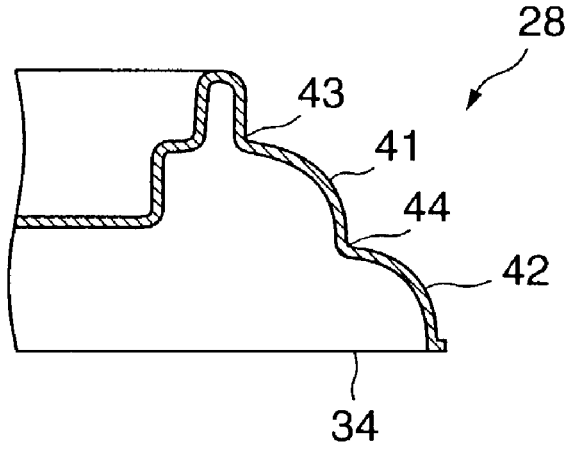

FIG. 22A shows the state of the curved surface 28 in which the shock is not administered. When the shock is administered from the side in the direction of the arrow shown in the drawing, the curve rate of the curve between the first fulcrum 43 and the second fulcrum 44 of the first curved surface changes so that the curve is more articulated and the radius of the curve decreases as shown in FIG. 22B. Similarly, the curve rate of the curve between the second fulcrum 44 and the periphery bottom surface 34 of the second curved surface 42 changes so that the curve is more articulated and the radius of the curve decreases. This is due to the fact that the periphery bottom surface 34 and the periphery surface 64 of the tray pack 75 come into contact with the first flared walls 85 or second flared walls 86, which act as the sustaining walls of the box structure 81 as described in FIG. 14, and thus the contacting portions hold the tray pack 75 in place within the box structure 81. The deformations occur from the load of the contained product 1 upon these portions.

The above deformation is different from the deformation in FIG. 21 in that the first tray pack 21 and the second tray pack 51 are joined together and contained in a box structure 81 and thus deformation through change of height of the tray pack is limited by the height within the box structure 81. Therefore, elastic deformation occurs instead as shown in FIG. 22B. Naturally, the same deformation applies to the second tray pack 51 as well. The deformation occurs at the moment of the shock impact and recovers in a short period of time in accordance with the damped vibrations of the shock impact, diffusing the shock impact cast upon the contained product 1.

As shown in FIG. 14, the only places in which the tray pack is held in position by the box structure 81 are the portions where the perimeters of the peripheral bottom surface 34 and the peripheral surface 64 of the tray pack 75 come into contact with the first flared walls 85 and the second flared walls 86 which are the sustaining portions. Thus, for the other parts of the tray pack, effective shock diffusion is achieved through deformation at these sustaining portions of the flared walls 85 and 86.

Further, it is clear that the above shock diffusion from combined effects can be obtained not only for shock impacts from the upper and bottom surfaces or side surfaces of the tray pack 75, but from other directions such as from the edges or corners of the box structure 81.

As for the contact flaps 87 described in FIG. 14 and FIG. 15, the local pressures exerted from these contact flaps 87 have the effect of controlling not only the elastic deformation described in FIG. 21 occurring in response to the shock impact from the surface, but also movement due to vibrations from the shock impact.

In evaluating the effects upon the contained product placed in a box structure 81 having double layered wall surfaces 84, flared walls 85 and 86 arranged at the inner sides, and contact flaps 87, the shock impact values of the contained product described above will be compared with that of the product placed in a box without the above-mentioned arrangements. In the case of the product contained in the box structure 81 corresponding to the present invention, the shock impact values from falling on a surface, an edge, or a corner are 48G, 42G, and 40G, respectively. Whereas, in the case of the product placed in a box structure without the appropriate measures, the shock impact values from falling on a surface, an edge, or a corner are 62G, 56G, and 54G, respectively. From the above comparison, it is clear that there is a significant difference between these two instances.

Figure 23A:
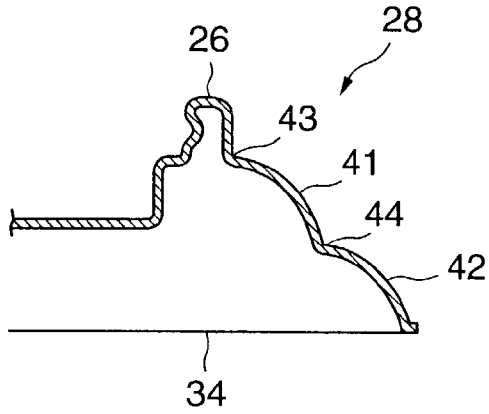
FIG. 23A–23C are illustrative comparison drawings between the plurality of curved surfaces according to the present invention and other different configurations.
Figure 23B:
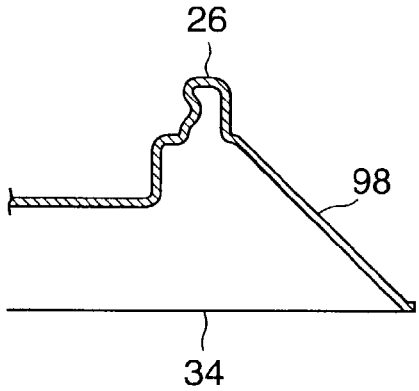
Figure 23C:
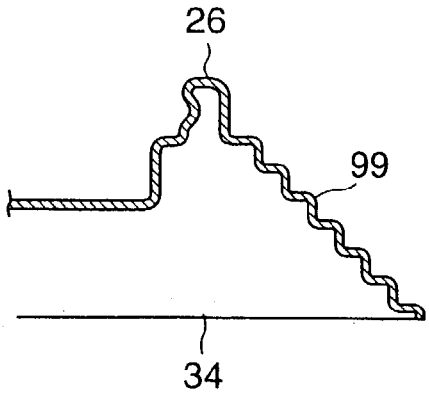

Also, in order to show the effectiveness of forming a multi-curved surface on the periphery of the tray pack, other embodiments are shown in FIG. 23. FIG. 23A shows the curved surface 28 according to the present invention; whereas, FIG. 23B shows a linear flat slope 98 and FIG. 23C shows a staircase-like surface 99 as examples. The latter two embodiments will be too rigid due to their lack of elasticity and therefore will be incapable of diffusing and absorbing shock impacts.

Figure 24:
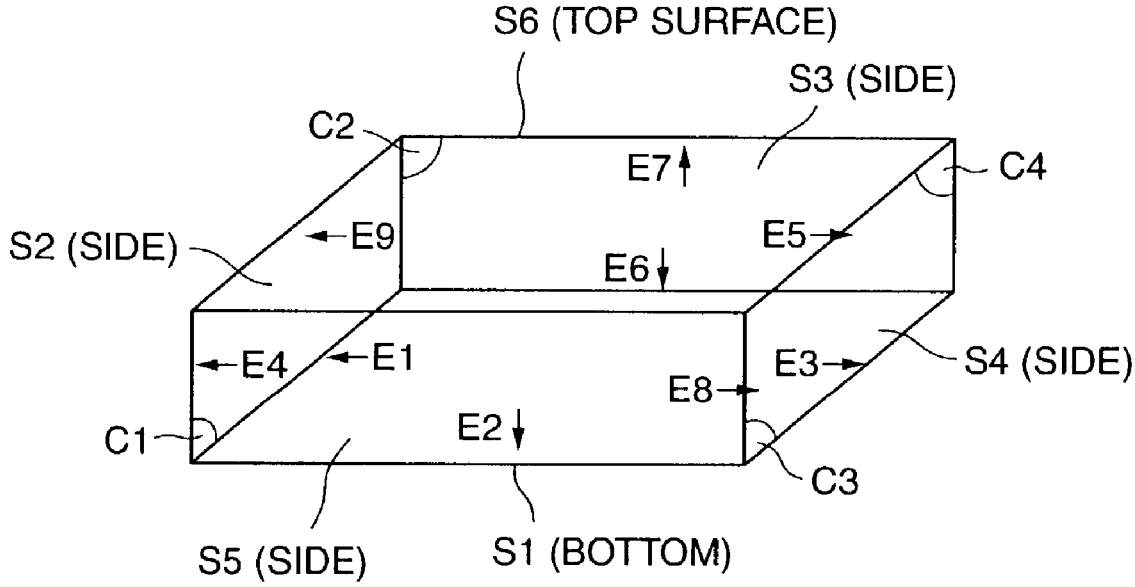
FIG. 24 is a perspective view showing the falling direction of the packaging structure according to the invention and the box which is the packaging structure of the conventional art.
Figure 25:
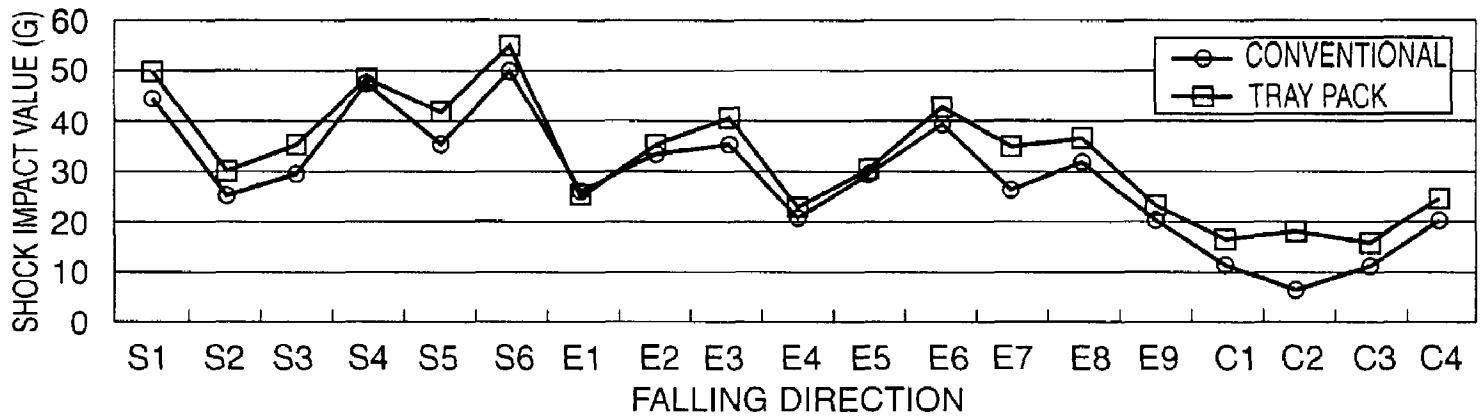
FIG. 25 is a comparison chart of the shock values corresponding to different falling directions.
Figure 27A:
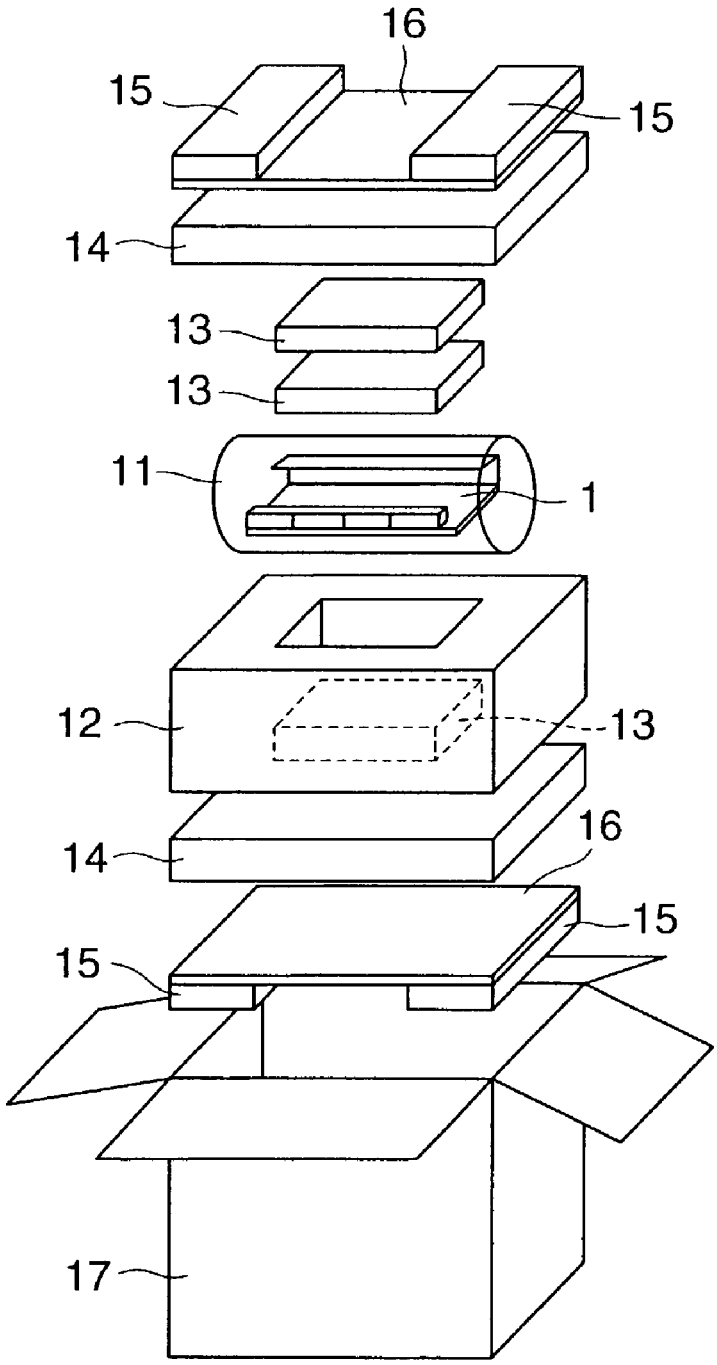
FIG. 27A–27B are illustrative drawings showing the composition of a conventional packaging structure.
Figure 27B:
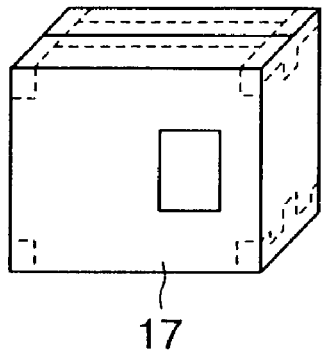

Lastly, a comparison will be made between the composition of the packaging structure according to the conventional embodiment illustrated in FIG. 27, and that according to the present invention illustrated in FIG. 14 and 15 by means of a falling test. The resulting shock diffusion values from the shocks administered to the contained product from the directions S1–S6, E1–E9, C1–C4 shown in FIG. 24, are indicated in a chart in FIG. 25. Since no significant differences can be detected between the two different structures from FIG. 25, it could be assumed that the present invention has virtually the same capacity as the conventional embodiment and that problems are not very likely to arise from using the present invention as a replacement.

The above description of the preferred embodiments is given with reference to the circuit unit as the product for utilizing the packaging structure according to the present invention. However, the present invention is not limited to the use on the above unit but can be used for anything that requires protection against shock impacts coming from all possible directions.

Further, the curved surface does not necessarily have to be composed of two curves but can rather be composed of multi-curved surfaces.

Also, the embodiments of the concave and convex engaging portions 27 and 54 arranged on the first tray pack 21 and second tray pack 51 and used for holding the joined tray packs together, are not limited to the above-mentioned embodiments and can possibly be arranged on one or the other.

Although it has been mentioned above that the tray packs must be made of conductive material, various embodiments are possible. For example, selection can be made from a tray pack with a conductive film covering its surface, a tray pack whose material itself consists of a mixture of conductive material, etc.

In a case where the contained product is susceptible to electrostatics such as the circuit unit, the tray pack 75 is preferably put in a thin transparent bag made of conductive film so that ESD (electrostatics disorders) due to human handling that occur when the products are taken out by human hands can also be prevented.

A first embodiment of the present invention can be further described as follows: a packaging structure comprising a tray pack made of elastic material comprising:

a first tray pack and a second tray pack provided with sustaining portions sustaining the areas around the contained product; a plate composed of multiple sets of protrusions/indentations having protrusions/indentations of different sizes and heights, said plate being spaced apart from the above contained product; and a curved surface formed on the outer sides of the tray pack, enabling elastic deformation around the above sustaining portions, and composed of at least a first curved surface and a second curved surface that is extended from the first curved surface; wherein:

the first tray pack and the second tray pack face opposite one another and are adjoined together to hold the contained product securely in place by fitting together concave and convex engaging portions formed at the periphery of the above first tray pack and the second tray pack.

The first embodiment of the present invention can be further described as follows: a packaging structure comprising:

a tray pack made of elastic material which includes a first tray pack and a second tray pack provided with sustaining portions sustaining the areas around the contained product; a plate composed of multiple sets of protrusions/indentations having protrusions/indentations of different sizes and heights, said plate being spaced apart from the above contained product; and a curved surface formed in order to enable elastic deformation around the above sustaining portions and composed of at least a first curved surface and a second curved surface that extends from the first curved surface; wherein the above tray pack is formed by fitting together the concave and convex engaging portions at the perimeters of the first tray pack and the second tray pack so that they face each other to hold the contained product securely in place; and, a box structure composed of a box portion for containing the above tray pack and a lid portion for covering the opening of said box portion, provided with sustaining portions which sustain the tray pack by coming into contact with the outer surface of the tray pack at the inner sides of the box portion, and contact flaps which come into contact with the upper surface of the contained tray pack, wherein the above contact flaps support the tray pack when the lid portion of the box structure is shut so that their inner surface holds down the contact flaps resulting in their touching the outer surface of the tray pack.

A packaging structure in accordance with either one of the first or second embodiment as described above, characterized in that the tray pack made of elastic material is particularly made of synthetic resin having elasticity molded into a sheet form.

A packaging structure characterized by comprising a shock absorption structure having first protrusions/indentations and at least 3 second protrusions/indentations that surround said first protrusion, wherein:

the above first protrusions/indentations and second protrusions/indentations are placed on one plane facing downward, and thus the tips of the first protrusions/indentations touching said plane and the tips of the second protrusions/indentations having some space in between said plane; and wherein:

sustaining portions are set opposite the protruding surface formed by the above first and second protrusions/indentations so that they sustain the contained product. (3)

A packaging structure as described in any one of either the first or second embodiment, wherein the tray pack is provided with conductivity.

A packaging structure as described in any one of either the first or second embodiment, wherein the protrusions/indentations of the sets of protrusions/indentations in the tray pack may be spherical or pyramidal in shape.

A packaging structure as described in the second embodiment, wherein the box structure is made of one piece of cardboard material and is formed by folding and adjoining a box portion and a lid portion together.

The packaging structure according to the present invention as described in detail above, will allow various beneficial changes from the conventional embodiment. Due to the change in the composition material, the material cost can be reduced by 30%; from the reduction of the package size, the holding capacity of the big shipping container box can be increased by 600%; and also, the necessary space for storing the individual packaging materials can be reduced by 70%. Further, due to the change in size and material of the packaging structure, the amount of waste generated upon the disposal of the materials can be reduced by 70%.

The tray pack, being made of conductive material, can also act as a palette for assembling the contained product at the production line in its manufacturing process. Further, measures can be taken to protect each contained product from ESD (electrostatic disorder) during its assembly process, and secondary materials used in packaging the contained products for better protection such as conductive bags or conductive tape will no longer be needed.

Additionally, the operation time for the packaging process can be reduced by 50% since it only requires placing the product inside one of the tray packs and then fitting in the other tray pack pair, thus increasing labor efficiency. The same applies to the box structure as well.

The advantages of the present invention such as its high versatility and high performance is evident upon practical use. The present invention is applicable for a very wide range of products that require protection against shock impacts coming from every direction and each component part work in unison to enable shock diffusion by a gradual phased deformation.

What is claimed is:

1. A tray pack comprising:

a first tray pack and a second tray pack, each made of an elastic thin sheet resin, engageable for suspending a product therein, the first tray pack having a recessed center portion surrounded by a raised frame having an inner side with various stepped shaped members and an outer side having a multi-curved surface shape, the recessed center portion is formed by a plate containing a plurality of protrusions;

the inner side of the raised frame, adjoining the plate of the recessed center portion, includes sustaining portions configured to contact the product contained in the tray pack and step portions, above the sustaining portions configured to contact the second tray pack;

the outer side of the raised frame including a multi-curved surface formed of multiple curved surfaces; and the second tray pack having a recessed center portion surrounded by a raised frame having an inner side and an outer side, the outer side having sustaining portions and a multi-curved surface shape, the recessed center portion including a plate containing a plurality of protrusions;

the inner side of the raised frame adjoins the plate of the recessed center portion; and the outer side of the raised frame including sustaining portions configured to contact the step portions of the first tray pack;

wherein the first tray pack and second tray pack are faced opposed to each other so as to suspend the product securely in place via the first tray pack sustaining portions, and wherein the plate of the recessed center portion, of both the first and second tray pack, is comprised of a plurality of protrusions, of two different heights and sizes, evenly spaced in an alternating arrangement, wherein the taller of the two protrusions extends from the plate of the recessed center portion to an outer surface of the respective first and second tray pack.

2. A tray pack comprising:

a first tray pack and a second tray pack, each made of an elastic thin sheet resin, engageable for suspending a product therein, the first tray pack having a recessed center portion surrounded by a raised frame having an inner side with various stepped shaped members and an outer side having a multi-curved surface shape, the recessed center portion is formed by a plate containing a plurality of protrusions;

the inner side of the raised frame, adjoining the plate of the recessed center portion, includes sustaining portions configured to contact the product contained in the tray pack and step portions, above the sustaining portions configured to contact the second tray pack;

the outer side of the raised frame including a multi-curved surface formed of multiple curved surfaces; and the second tray pack having a recessed center portion surrounded by a raised frame having an inner side and an outer side, the outer side having sustaining portions and a multi-curved surface shape, the recessed center portion including a plate containing a plurality of protrusions;

the inner side of the raised frame adjoins the plate of the recessed center portion; and the outer side of the raised frame including sustaining portions configured to contact the step portions of the first tray pack;

wherein the first tray pack and second tray pack are faced opposed to each other so as to suspend the product securely in place via the first tray pack sustaining portions, and wherein the plate of the recessed center portion, of both the first and second tray pack, is comprised of a plurality of protrusions, of three different consecutive heights and sizes, evenly spaced, wherein the tallest of the three protrusions extends from the plate of the recessed center portion to an outer surface of the respective first and second tray pack.

3. A tray pack comprising:

a first tray pack and a second tray pack, each made of an elastic thin sheet resin, engageable for suspending a product therein, the first tray pack having a recessed center portion surrounded by a raised frame having an inner side with various stepped shaped members and an outer side having a multi-curved surface shape, the recessed center portion is formed by a plate containing a plurality of protrusions;

the inner side of the raised frame, adjoining the plate of the recessed center portion, includes sustaining portions configured to contact the product contained in the tray pack and step portions, above the sustaining portions configured to contact the second tray pack;

the outer side of the raised frame including a multi-curved surface formed of multiple curved surfaces; and the second tray pack having a recessed center portion surrounded by a raised frame having an inner side and an outer side, the outer side having sustaining portions and a multi-curved surface shape, the recessed center portion including a plate containing a plurality of protrusions;

the inner side of the raised frame adjoins the plate of the recessed center portion; and the outer side of the raised frame including sustaining portions configured to contact the step portions of the first tray pack;

wherein the first tray pack and second tray pack are faced opposed to each other so as to suspend the product securely in place via the first tray pack sustaining portions, and wherein the plate of the recessed center portion, of both the first and second tray packs, is comprised of a plurality of protrusions of different heights and sizes evenly spaced, wherein the tallest of the protrusions extends from the plate of the recessed center portion to an outer surface of the respective first and second tray pack.

4. A packaging structure comprising:

a tray pack having a first tray pack and a second tray pack, each made of an elastic thin sheet resin, engageable for suspending a product therein, the first tray pack having a recessed center portion surrounded by a raised frame having an inner side with stepped shaped members and an outer side having a multi-curved surface shape, the recessed center portion is formed by a plate containing a plurality of protrusions;

the inner side of the raised frame, adjoining the plate of the recessed center portion, includes sustaining portions configured to contact the product contained in the tray pack, step portions, above the sustaining portions, configured to contact the second tray pack, and engaging portions above the step portions, configured to engage respective portions of the second tray pack in a tight fit due to elastic properties of the tray pack resin;

the outer side of the raised frame includes a multi-curved surface formed of multiple curved surfaces; and the second tray pack having a recessed center portion surrounded by a raised frame having an inner side and an outer side, the outer side having sustaining portions and a multi-curved surface shape, the recessed center portion is formed by a plate containing a plurality of protrusions;

the inner side of the raised frame adjoins the plate of the recessed center portion; and the outer side of the raised frame includes sustaining portions configured to contact the step portions of the first tray pack, and engaging portions below the sustaining portions, configured to engage respective portions of the first tray pack in a tight fit due to the elastic properties of the tray pack resin; and a box configured to contain said tray pack therein in a contacting relationship with flared walls formed on a bottom portion of the box; the box including a lid connected to the bottom portion;

the bottom portion having a first set of opposing side walls having formed on each opposing side wall a flared wall opposing the flared wall of the opposite side wall, and a second set of opposing side walls having formed on each opposing side wall a flared wall opposing the flared wall of the opposite sidewall, said flared walls of the second set of opposing side walls additionally having foldable contact flaps formed thereon for contacting said tray pack;

wherein the first tray pack and second tray pack are faced opposed to each other so as to suspend the product securely in place via the first tray pack sustaining portions and by engaging respective engaging portions of the first and second tray packs, formed on the frames at perimeters of the first and second tray packs; and wherein said first tray pack is fitted into the bottom of the box contacting only the flared walls on the first and second set of opposing side walls with the contact flaps placed as to cover the upper surface of the perimeter of the second tray pack.

* * * * *